US009489804B2

(12) United States Patent
Ward et al.

(10) Patent No.: US 9,489,804 B2
(45) Date of Patent: Nov. 8, 2016

(54) COMMUNITY GAMING SYSTEM WITH VARYING ELIGIBILITY CRITERIA

(71) Applicant: WMS Gaming Inc., Waukegan, IL (US)

(72) Inventors: Matthew J. Ward, Northbrook, IL (US); Mark B. Gagner, West Chicago, IL (US); Joel R. Jaffe, Glenview, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/783,584

(22) Filed: Mar. 4, 2013

(65) Prior Publication Data

US 2014/0094276 A1 Apr. 3, 2014

Related U.S. Application Data

(60) Provisional application No. 61/707,244, filed on Sep. 28, 2012.

(51) Int. Cl.
*G07F 17/32* (2006.01)

(52) U.S. Cl.
CPC ..... *G07F 17/3272* (2013.01)

(58) Field of Classification Search
CPC ..... G07F 17/3272
USPC ..... 463/16, 20, 25, 26, 29, 42
See application file for complete search history.

(56) References Cited

U.S. PATENT DOCUMENTS

| | | | |
|---|---|---|---|
| 4,455,025 | A | 6/1984 | Itkis |
| 4,572,509 | A | 2/1986 | Sitrick |
| 4,624,459 | A | 11/1986 | Kaufman |
| 4,624,462 | A | 11/1986 | Itkis |
| 4,837,728 | A | 6/1989 | Barrie et al. |
| 4,948,134 | A | 8/1990 | Suttle et al. |
| 5,102,138 | A | 4/1992 | Johnson |
| 5,116,055 | A | 5/1992 | Tracy |
| 5,249,800 | A | 10/1993 | Hilgendorf et al. |
| 5,275,400 | A | 1/1994 | Weingardt et al. |
| 5,280,909 | A | 1/1994 | Tracy |
| 5,344,144 | A | 9/1994 | Canon |
| 5,377,973 | A | 1/1995 | Jones et al. |
| 5,393,057 | A | 2/1995 | Marnell, II |

(Continued)

FOREIGN PATENT DOCUMENTS

| | | |
|---|---|---|
| CA | 2334546 | 8/2001 |
| DE | 19515983 | 11/1996 |

(Continued)

OTHER PUBLICATIONS

"Using Dynamic QR Codes to Deliver Variable Content," published on or before Mar. 2012, accessed and printed from URL <http://gofranklingo.wordpress.com/tag/casino-marketing/>, 3 pages.*

*Primary Examiner* — Jason Skaarup
(74) *Attorney, Agent, or Firm* — Nixon Peabody LLP

(57) ABSTRACT

A computer-implemented method includes displaying a community game on at least one display device. Dependent upon a first player playing an underlying wagering game via a first terminal, the first player is permitted to participate in the community game. The community game is distinct from the underlying wagering game. Not dependent upon a second player playing an underlying wagering game via a second terminal, the second player is permitted to participate in the community game.

19 Claims, 10 Drawing Sheets

(56) References Cited

U.S. PATENT DOCUMENTS 5,524,888 A 6/1996 Heidel
5,544,892 A 8/1996 Breeding
5,564,700 A 10/1996 Celona
5,580,063 A 12/1996 Edwards
5,580,309 A 12/1996 Piechowiak et al.
5,611,730 A 3/1997 Weiss
5,618,232 A 4/1997 Martin
5,645,486 A 7/1997 Nagao et al.
5,655,961 A 8/1997 Acres et al.
5,711,715 A 1/1998 Ringo et al.
5,755,621 A 5/1998 Marks et al.
5,766,076 A 6/1998 Pease et al.
RE35,864 E 7/1998 Weingardt
5,779,549 A 7/1998 Walker et al.
5,816,918 A 10/1998 Kelly et al.
5,823,874 A 10/1998 Adams
5,830,063 A 11/1998 Byrne
5,848,932 A 12/1998 Adams
5,855,515 A 1/1999 Pease et al.
5,876,284 A 3/1999 Acres et al.
5,885,158 A 3/1999 Torangp et al.
5,941,773 A 8/1999 Harlick
5,975,528 A 11/1999 Halaby
6,001,016 A 12/1999 Walker et al.
6,007,427 A 12/1999 Wiener et al.
6,012,982 A 1/2000 Piechowiak et al.
6,012,983 A 1/2000 Walker et al.
6,039,648 A 3/2000 Guinn et al.
6,047,963 A 4/2000 Pierce et al.
6,068,553 A 5/2000 Parker
6,077,162 A 6/2000 Weiss
6,089,977 A 7/2000 Bennett
6,089,980 A 7/2000 Gauselmann
6,102,474 A 8/2000 Daley
6,102,798 A 8/2000 Bennett
6,102,799 A 8/2000 Stupak
6,104,815 A 8/2000 Alcorn et al.
6,110,043 A 8/2000 Olsen
6,117,013 A 9/2000 Eiba
6,139,013 A 10/2000 Pierce et al.
6,142,872 A 11/2000 Walker et al.
6,146,273 A 11/2000 Olsen
6,155,925 A 12/2000 Giobbi et al.
6,158,741 A 12/2000 Koelling
6,159,097 A 12/2000 Gura
6,168,523 B1 1/2001 Piechowiak et al.
6,203,010 B1 3/2001 Jorasch et al.
6,206,374 B1 3/2001 Jones
6,206,782 B1 3/2001 Walker et al.
6,210,275 B1 4/2001 Olsen
6,210,277 B1 4/2001 Stefan
6,217,448 B1 4/2001 Olsen
6,220,593 B1 4/2001 Pierce et al.
6,224,482 B1 5/2001 Bennett
6,224,484 B1 5/2001 Okuda et al.
6,231,445 B1 5/2001 Acres
6,254,483 B1 7/2001 Acres
6,270,410 B1 8/2001 DeMar et al.
6,287,202 B1 9/2001 Pascal et al.
6,293,865 B1 9/2001 Kelly et al.
6,309,299 B1 10/2001 Weiss
6,312,232 B1 11/2001 Mori et al.
6,312,332 B1 11/2001 Walker et al.
6,315,660 B1 11/2001 DeMar et al.
6,319,125 B1 11/2001 Acres
6,319,127 B1 11/2001 Walker et al.
6,335,862 B1 1/2002 Koya
6,336,859 B2 1/2002 Jones et al.
6,345,824 B1 2/2002 Selitzky
6,358,149 B1 3/2002 Schneider et al.
6,361,441 B1 3/2002 Walker et al.
6,364,314 B1 4/2002 Canterbury
6,364,768 B1 4/2002 Acres et al.
6,375,567 B1 4/2002 Acres
6,375,568 B1 4/2002 Roffman et al.
6,409,602 B1 6/2002 Wiltshire et al.
6,416,408 B2 7/2002 Tracy et al.
6,416,409 B1 7/2002 Jordan
6,422,940 B1 7/2002 Walker et al.
6,431,983 B2 8/2002 Acres
6,435,968 B1 8/2002 Torango
6,439,995 B1 8/2002 Hughs-Baird et al.
6,482,089 B2 11/2002 DeMar et al.
6,506,117 B2 1/2003 DeMar et al.
6,508,707 B2 1/2003 DeMar et al.
6,508,710 B1 1/2003 Paravia et al.
6,517,433 B2 2/2003 Loose et al.
6,520,855 B2 2/2003 DeMar et al.
6,524,188 B2 2/2003 Wang
6,527,638 B1 3/2003 Walker et al.
6,589,115 B2 7/2003 Walker et al.
6,592,460 B2 7/2003 Torango
6,599,186 B1 7/2003 Walker et al.
6,599,188 B2 7/2003 Hirsch et al.
6,599,193 B2 7/2003 Baerlocher et al.
6,609,973 B1 8/2003 Weiss
6,628,939 B2 9/2003 Paulsen
6,648,753 B1 11/2003 Tracy et al.
6,648,762 B2 11/2003 Walker et al.
6,665,715 B1 12/2003 Houri
6,676,522 B2 1/2004 Rowe et al.
6,682,421 B1 1/2004 Rowe et al.
6,685,560 B1 2/2004 Hughes
6,692,354 B2 2/2004 Tracy et al.
6,712,695 B2 3/2004 Mothwurf et al.
6,712,699 B2 3/2004 Walker et al.
6,733,390 B2 5/2004 Walker et al.
6,790,141 B2 9/2004 Muir
6,800,026 B2 10/2004 Cannon
6,800,029 B2 10/2004 Rowe et al.
6,837,793 B2 1/2005 McClintic
6,843,725 B2 1/2005 Nelson
6,846,238 B2 1/2005 Wells
6,869,361 B2 3/2005 Sharpless et al.
6,884,167 B2 4/2005 Walker et al.
6,887,151 B2 5/2005 Leen et al.
6,887,154 B1 5/2005 Luciano, Jr. et al.
6,887,159 B2 5/2005 Leen et al.
6,908,390 B2 6/2005 Nguyen et al.
6,916,244 B2 7/2005 Gatto et al.
6,916,245 B1 7/2005 Vancura et al.
6,921,331 B2 7/2005 Gatto et al.
6,923,724 B2 8/2005 Williams
6,935,952 B2 8/2005 Walker et al.
6,971,956 B2 12/2005 Rowe et al.
7,077,744 B2 7/2006 Cannon
7,097,562 B2 8/2006 Gagner
7,169,041 B2 1/2007 Tessmer et al.
7,169,044 B2 1/2007 Baerlocher et al.
7,226,358 B2 6/2007 Miller et al.
7,234,117 B2 6/2007 Zaner et al.
7,270,605 B2 9/2007 Russell et al.
7,316,609 B2 1/2008 Dunn et al.
7,331,868 B2 2/2008 Beaulieu et al.
7,371,166 B1 5/2008 Webb et al.
7,431,646 B2 10/2008 Jackson
7,662,040 B2 2/2010 Englman et al.
7,780,531 B2 8/2010 Englman et al.
7,931,530 B2 4/2011 Anderson et al.
8,197,331 B2 6/2012 Pacey et al.
8,235,785 B2 8/2012 Thomas
8,292,719 B2 10/2012 Englman et al.
8,303,394 B2 11/2012 Englman et al.
8,342,927 B2 1/2013 Englman et al.
8,622,814 B2 1/2014 Englman et al.
2002/0039923 A1 4/2002 Cannon et al.
2002/0065097 A1 5/2002 Brockenbrough et al.
2002/0068631 A1 6/2002 Raverdy et al.
2002/0077170 A1 6/2002 Johnson et al.
2002/0086729 A1 7/2002 Emmerson et al.
2002/0119824 A1 8/2002 Allen
2002/0138594 A1 9/2002 Rowe
2002/0147047 A1 10/2002 Letovsky
2002/0147049 A1 10/2002 Carter

(56) References Cited

U.S. PATENT DOCUMENTS

2002/0151345 A1 10/2002 Byrne
2002/0151363 A1 10/2002 Letovsky et al.
2002/0155874 A1 10/2002 Byrne
2002/0183107 A1 12/2002 Wolfe
2003/0006931 A1 1/2003 Mages
2003/0008703 A1 1/2003 Gauselmann
2003/0027618 A1 2/2003 Byrne
2003/0036430 A1 2/2003 Cannon
2003/0045337 A1 3/2003 Byrne
2003/0047874 A1 3/2003 Leen et al.
2003/0050106 A1 3/2003 Lyfoung
2003/0060264 A1 3/2003 Chilton et al.
2003/0064776 A1 4/2003 Byrne
2003/0064807 A1 4/2003 Gelman et al.
2003/0070178 A1 4/2003 Boyd et al.
2003/0104865 A1 6/2003 Itkis et al.
2003/0114217 A1 6/2003 Walker et al.
2003/0114218 A1 6/2003 McClintic
2003/0119576 A1 6/2003 McClintic et al.
2003/0125107 A1 7/2003 Cannon
2003/0139190 A1 7/2003 Steelberg et al.
2003/0148808 A1 8/2003 Price
2003/0181231 A1 9/2003 Vancura et al.
2003/0186733 A1 10/2003 Wolf et al.
2003/0190960 A1 10/2003 Jokipii et al.
2003/0216166 A1 11/2003 Baerlocher et al.
2003/0222402 A1 12/2003 Olive
2003/0224852 A1 12/2003 Walker et al.
2003/0224855 A1 12/2003 Cunningham
2003/0228899 A1 12/2003 Evans
2003/0236116 A1 12/2003 Marks et al.
2004/0009808 A1 1/2004 Gauselmann
2004/0009811 A1 1/2004 Torango
2004/0038741 A1 2/2004 Gauselmann
2004/0048644 A1 3/2004 Gerrard et al.
2004/0087368 A1 5/2004 Gauselmann
2004/0087370 A1 5/2004 Tarantino
2004/0106448 A1 6/2004 Gauselmann
2004/0121842 A1 6/2004 Willis et al.
2004/0127284 A1 7/2004 Walker et al.
2004/0132524 A1 7/2004 Ramstad et al.
2004/0137987 A1 7/2004 Nguyen et al.
2004/0139468 A1 7/2004 Kidd
2004/0140989 A1 7/2004 Papageorge
2004/0162124 A1 8/2004 Barton
2004/0176156 A1 9/2004 Walker et al.
2004/0193431 A1 9/2004 Campbell
2004/0204226 A1 10/2004 Foster et al.
2004/0204235 A1 10/2004 Walker et al.
2004/0224769 A1 11/2004 Hansen et al.
2004/0235552 A1 11/2004 Gauselmann
2004/0240741 A1 12/2004 Leaute et al.
2004/0242297 A1 12/2004 Walker et al.
2004/0242303 A1 12/2004 Walker et al.
2004/0248637 A1 12/2004 Liebenberg
2004/0266517 A1 12/2004 Bleich et al.
2005/0003881 A1 1/2005 Byng
2005/0003883 A1 1/2005 Muir et al.
2005/0003886 A1 1/2005 Engleman et al.
2005/0009600 A1 1/2005 Rowe et al.
2005/0014554 A1 1/2005 Walker et al.
2005/0020340 A1 1/2005 Cannon
2005/0026674 A1 2/2005 Wolf et al.
2005/0026697 A1 2/2005 Balahura et al.
2005/0037708 A1 2/2005 Torvinen
2005/0043088 A1 2/2005 Nguyen et al.
2005/0043089 A1 2/2005 Nguyen et al.
2005/0043094 A1 2/2005 Nguyen et al.
2005/0071024 A1 3/2005 Henshaw
2005/0071481 A1 3/2005 Danieli
2005/0076092 A1 4/2005 Chang et al.
2005/0096133 A1 5/2005 Hoefelmeyer et al.
2005/0102047 A1 5/2005 Ottofy
2005/0113162 A1 5/2005 Olive et al.
2005/0130728 A1 6/2005 Nguyen et al.
2005/0143169 A1 6/2005 Nguyen et al.
2005/0148382 A1 7/2005 Fox
2005/0170876 A1 8/2005 Masci et al.
2005/0181856 A1 8/2005 Cannon et al.
2005/0187008 A1 8/2005 Nakajima
2005/0187020 A1 8/2005 Amaitis et al.
2005/0192073 A1 9/2005 Nakajima
2005/0193209 A1 9/2005 Saunders et al.
2005/0197190 A1 9/2005 Amaitis et al.
2005/0227770 A1 10/2005 Papulov
2005/0282628 A1 12/2005 Beatty et al.
2005/0282637 A1 12/2005 Gatto et al.
2006/0009283 A1* 1/2006 Englman et al. ..... 463/29
2006/0010204 A1 1/2006 Jalava et al.
2006/0030959 A1 2/2006 Duhamel
2006/0035707 A1 2/2006 Nguyen et al.
2006/0040742 A1 2/2006 Wright et al.
2006/0073880 A1 4/2006 Thomas
2006/0073897 A1 4/2006 Englman et al.
2006/0082056 A1 4/2006 Kane et al.
2006/0084494 A1 4/2006 Belger et al.
2006/0094495 A1 5/2006 Gelber et al.
2006/0121971 A1 6/2006 Slomiany et al.
2006/0135243 A1* 6/2006 Englman et al. ..... 463/16
2006/0148565 A1 7/2006 Gauselmann et al.
2006/0160625 A1 7/2006 Englman et al.
2006/0178202 A1 8/2006 Hughes et al.
2006/0183550 A1 8/2006 Gagner et al.
2006/0189382 A1 8/2006 Muir et al.
2006/0194589 A1 8/2006 Sankisa
2006/0205459 A1 9/2006 Rehkemper et al.
2006/0234791 A1 10/2006 Nguyen et al.
2006/0241795 A1 10/2006 Weingardt et al.
2006/0252546 A1 11/2006 Castellari et al.
2006/0287043 A1 12/2006 Englman et al.
2006/0287106 A1 12/2006 Jensen
2007/0021198 A1 1/2007 Muir et al.
2007/0054739 A1 3/2007 Amaitis et al.
2007/0060292 A1 3/2007 Peterson
2007/0060305 A1 3/2007 Amaitis et al.
2007/0060306 A1 3/2007 Amaitis et al.
2007/0060317 A1 3/2007 Martin
2007/0060355 A1 3/2007 Amaitis et al.
2007/0060358 A1 3/2007 Amaitis et al.
2007/0066401 A1 3/2007 Amaitis et al.
2007/0066402 A1 3/2007 Amaitis et al.
2007/0078962 A1 4/2007 Donnelli et al.
2007/0082725 A1 4/2007 Low et al.
2007/0087832 A1 4/2007 Abbott et al.
2007/0111797 A1 5/2007 Sasaki et al.
2007/0129128 A1 6/2007 McClintic
2007/0129147 A1 6/2007 Gagner
2007/0136817 A1 6/2007 Nguyen
2007/0149279 A1 6/2007 Norden et al.
2007/0173324 A1 7/2007 Multerer et al.
2007/0191100 A1 8/2007 Counts
2007/0191105 A1 8/2007 Azuma
2007/0218996 A1 9/2007 Harris et al.
2008/0125206 A1 5/2008 Mouchou et al.
2008/0139274 A1 6/2008 Baerlocher
2008/0167130 A1 7/2008 Kroeckel et al.
2008/0254868 A1 10/2008 Fujimoto et al.
2009/0005165 A1 1/2009 Arezina et al.
2009/0093300 A1 4/2009 Lutnick et al.
2009/0098921 A1 4/2009 Manning et al.
2009/0098925 A1 4/2009 Gagner et al.
2009/0098943 A1 4/2009 Weber et al.
2009/0104963 A1 4/2009 Burman et al.
2009/0104965 A1 4/2009 House et al.
2009/0124385 A1* 5/2009 Cuddy et al. ..... 463/42
2009/0156303 A1 6/2009 Kiely et al.
2009/0197672 A1 8/2009 Kelly et al.
2010/0016056 A1 1/2010 Thomas et al.
2010/0062196 A1 3/2010 Bezek et al.
2010/0069160 A1 3/2010 Barrett et al.
2010/0093416 A1 4/2010 Seelig et al.
2010/0234099 A1 9/2010 Rasmussen et al.
2010/0248812 A1* 9/2010 Pacey et al. ..... 463/20
2011/0105233 A1 5/2011 Aoki

(56) References Cited

U.S. PATENT DOCUMENTS

| | | | | |
|---|---|---|---|---|
| 2012/0289301 | A1* | 11/2012 | Cuddy et al. | 463/16 |
| 2012/0289314 | A1* | 11/2012 | Tan | 463/25 |
| 2012/0289322 | A1* | 11/2012 | Causley | 463/26 |
| 2012/0295695 | A1* | 11/2012 | Baerlocher et al. | 463/25 |
| 2013/0079110 | A1* | 3/2013 | Nicely et al. | 463/25 |
| 2013/0084965 | A1 | 4/2013 | Gura et al. | |
| 2013/0184042 | A1* | 7/2013 | Lutnick et al. | 463/13 |

FOREIGN PATENT DOCUMENTS

| | | |
|---|---|---|
| DE | 19624321 | 6/2002 |
| EP | 0521599 | 1/1993 |
| GB | 2153572 | 8/1985 |
| GB | 2181589 | 4/1987 |
| GB | 2242300 | 9/1991 |
| GB | 2313792 | 12/1997 |
| GB | 2333880 | 8/1999 |
| WO | WO 96/34368 | 10/1996 |
| WO | WO 98/51384 | 11/1998 |
| WO | WO 99/03078 | 1/1999 |
| WO | WO 99/19037 | 4/1999 |
| WO | WO 01/33478 | 5/2001 |
| WO | WO 01/99067 | 12/2001 |
| WO | WO 03/026754 | 4/2003 |
| WO | WO 03/067175 | 8/2003 |
| WO | WO 03/083789 | 10/2003 |
| WO | WO 03/083796 | 10/2003 |
| WO | WO 2004/000428 | 12/2003 |
| WO | WO 2005/035089 | 4/2005 |
| WO | WO 2005/077480 | 8/2005 |
| WO | WO 2005/086399 | 9/2005 |
| WO | WO 2005/102480 | 11/2005 |
| WO | WO 2005/113088 | 12/2005 |
| WO | WO 2006/015442 | 2/2006 |
| WO | WO 2006/028740 | 3/2006 |
| WO | WO 2006/039137 | 4/2006 |
| WO | WO 2006/121663 | 11/2006 |
| WO | WO 2007/006002 | 1/2007 |
| WO | WO 2007/008713 | 1/2007 |
| WO | WO 2007/022256 | 2/2007 |
| WO | WO 2007/030552 | 3/2007 |
| WO | WO 2007/030632 | 3/2007 |
| WO | WO 2007/030675 | 3/2007 |
| WO | WO 2007/030733 | 3/2007 |
| WO | WO 2007/030801 | 3/2007 |
| WO | WO 2007/087297 | 8/2007 |
| WO | WO 2007/103054 | 9/2007 |
| WO | WO 2007/127259 | 11/2007 |

* cited by examiner

COMMUNITY GAMING SYSTEM WITH VARYING ELIGIBILITY CRITERIA

CROSS-REFERENCE TO RELATED APPLICATION

This application claims the benefit of U.S. Provisional Application No. 61/707,244, filed Sep. 28, 2012, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering game systems and, more particularly, to a community gaming system with varying eligibility criteria.

BACKGROUND

Gaming machines or terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing terminals and the expectation of winning each terminal is roughly the same (or believed to be the same), players are most likely to be attracted to the more entertaining and exciting terminal. As a result, wagering game machine operators strive to employ the most entertaining and exciting machines available, because such machines attract frequent play and provide increased profitability for the operators.

SUMMARY OF THE INVENTION

A computer-implemented method includes displaying a community game on at least one display device. Dependent upon a first player playing an underlying wagering game via a first terminal, the first player is permitted to participate in the community game. The community game is distinct from the underlying wagering game. Not dependent upon a second player playing an underlying wagering game via a second terminal, the second player is permitted to participate in the community game.

A gaming system for conducting a wagering game including a community game includes one or more display devices, one or more processors, and one or more memory devices storing instructions that, when executed by at least one of the one or more processors, cause the gaming system to display a community game on at least one of the one or more display devices. Dependent upon a first player playing an underlying wagering game via a first terminal, the gaming system is further caused to permit the first player to participate in the community game. The community game is distinct from the underlying wagering game. Not dependent upon a second player playing an underlying wagering game via a second terminal, the gaming system is further caused to permit the second player to participate in the community game.

One or more physical machine-readable storage media including instructions which, when executed by one or more processors, cause the one or more processors to perform operations including displaying a community game on at least one display device. Dependent upon a first player playing an underlying wagering game via a first terminal, the operations further include permitting the first player to participate in the community game. The community game is distinct from the underlying wagering game. Not dependent upon a second player playing an underlying wagering game via a second terminal, the operations further include permitting the second player to participate in the community game.

A computer-implemented method includes displaying a community game on at least one display device. Dependent upon a first player playing a first underlying wagering game via a first terminal wherein the first underlying wagering game funds the community game, the first player is permitted to participate in the community game. Dependent upon a second player playing a second underlying wagering game via a second terminal wherein the second underlying wagering game does not fund the community game, the second player is permitted to participate in the community game.

One or more physical machine-readable storage media including instructions which, when executed by one or more processors, cause the one or more processors to perform operations comprising displaying a community game on at least one display device. Dependent upon a first player playing a first underlying wagering game via a first terminal wherein the first underlying wagering game funds the community game, the first player is permitted to participate in the community game. Dependent upon a second player playing a second underlying wagering game via a second terminal wherein the second underlying wagering game does not fund the community game, the second player is permitted to participate in the community game.

A method for conducting a wagering game including a community game includes receiving, via a first input device, a first wager from a first player of the wagering game on a first gaming terminal having game logic for determining an outcome of the wagering game based on a randomly generated number. A second wager is received, via a second input device, from a second player of the wagering game on a second gaming terminal lacking game logic for determining an outcome of the wagering game. The community game is caused to be triggered. A determination is made as to whether the first player of the wagering game on the first gaming terminal is eligible to play the triggered community game based on a first eligibility criterion. A second determination is made as to whether the second player of the wagering game on the second gaming terminal is eligible to play the triggered community game based on a second eligibility criterion that is distinct from the first eligibility criterion. The community game is conducted including displaying, on at least one community display device, a community game outcome that is the same for the first player and the second player.

A gaming system for conducting a wagering game including a community game includes a first input device, a second input device, one or more display devices, one or more processors, and one or more memory devices. The first input device is of a first gaming terminal has game logic for determining an outcome of the wagering game based on a randomly generated number. The second input device is of a second gaming terminal lacks game logic for determining an outcome of the wagering game. The one or more memory devices store instructions that, when executed by at least one of the one or more processors, cause the gaming system to: (i) receive, via the first input device, a first input indicative of a wager to play the wagering game, (ii) receive, via the second input device, a second input indicative of a wager to play the wagering game, (iii) cause the community game to be triggered, (iv) determine if a first player of the wagering game on the first gaming terminal is eligible to play the triggered community game based on a first eligibility criterion, (v) determine if a second player of the wagering game on the second gaming terminal is eligible to play the triggered community game based on a second eligibility criterion that is distinct from the first eligibility criterion, and (vi) conduct the community game including displaying, on at least one of the one or more display devices, a community game outcome that is the same for the first player and the second player.

One or more physical machine-readable storage media including instructions which, when executed by one or more processors, cause the one or more processors to perform the following operations. A first wager to play a first basic wagering game on a first gaming terminal having game logic for determining an outcome of the first basic wagering game based on a randomly generated number is received via a first input device. A second wager to play a second basic wagering game on a second gaming terminal lacking game logic for determining an outcome of the second basic wagering game is received via a second input device. A community game is caused to be triggered. Whether a first player of the first basic wagering game on the first gaming terminal is eligible to play the triggered community game based on a first eligibility criterion is determined. Whether a second player of the second basic wagering game on the second gaming terminal is eligible to play the triggered community game based on a second eligibility criterion that is distinct from the first eligibility criterion is determined. The community game is conducted including displaying, on a community display device, a community game outcome.

A method for conducting a wagering game including a basic game and a community game includes establishing a first communication link with a first gaming terminal having game logic for determining an outcome of the basic game based on a randomly generated number. A second communication link is established with a second gaming terminal lacking game logic for determining an outcome of the basic game. The community game is triggered. Whether a first player of the wagering game on the first gaming terminal is eligible to play the triggered community game based on a first eligibility criterion is determined. Whether a second player of the wagering game on the second gaming terminal is eligible to play the triggered community game based on a second eligibility criterion that is distinct from the first eligibility criterion is determined. The community game is caused to be conducted including causing a community game outcome to be displayed, on at least one community display device, that is the same for the first player and the second player.

A gaming system for conducting a wagering game including a community game includes a first input device, a second input device, one or more display devices, one or more processors, and one or more memory devices. The first input device of a first gaming terminal has game logic for determining an outcome of the wagering game based on a randomly generated number. The second input device of a second gaming terminal lacks game logic for determining an outcome of the wagering game. The one or more memory devices store instructions that, when executed by at least one of the one or more processors, cause the gaming system to: (i) establish a first communication link with the first gaming terminal, (ii) establish a second communication link with the second gaming terminal, (iii) trigger the community game, (iv) determine if a first player of the wagering game on the first gaming terminal is eligible to play the triggered community game based on a first eligibility criterion, (v) determine if a second player of the wagering game on the second gaming terminal is eligible to play the triggered community game based on a second eligibility criterion that is distinct from the first eligibility criterion, and (vi) conduct the community game including displaying, on at least one of the one or more display devices, a community game outcome that is the same for the first player and the second player.

Additional aspects of the present disclosure will be apparent to those of ordinary skill in the art in view of the detailed description of various implementations, which is made with reference to the drawings, a brief description of which is provided below.

Figure 1:
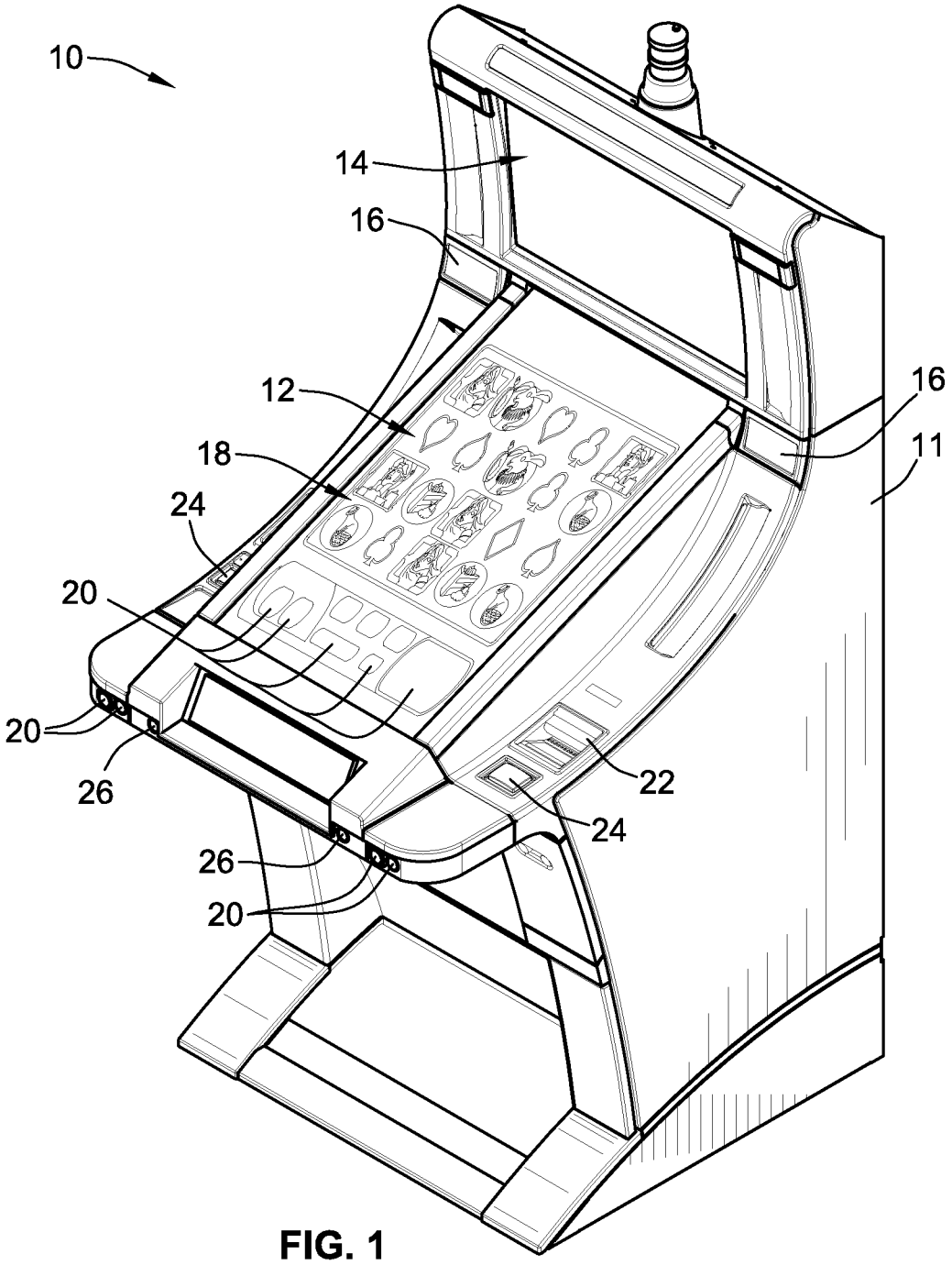
FIG. 1 is a perspective view of a free-standing gaming terminal according to some aspects of the present disclosure.

While the present disclosure is susceptible to various modifications and alternative forms, specific implementations have been shown by way of example in the drawings and will be described in detail herein. It should be understood, however, that the present disclosure is not intended to be limited to the particular forms disclosed. Rather, the disclosure is to cover all modifications, equivalents, and alternatives falling within the spirit and scope of the present invention as defined by the appended claims.

DETAILED DESCRIPTION

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication No. US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
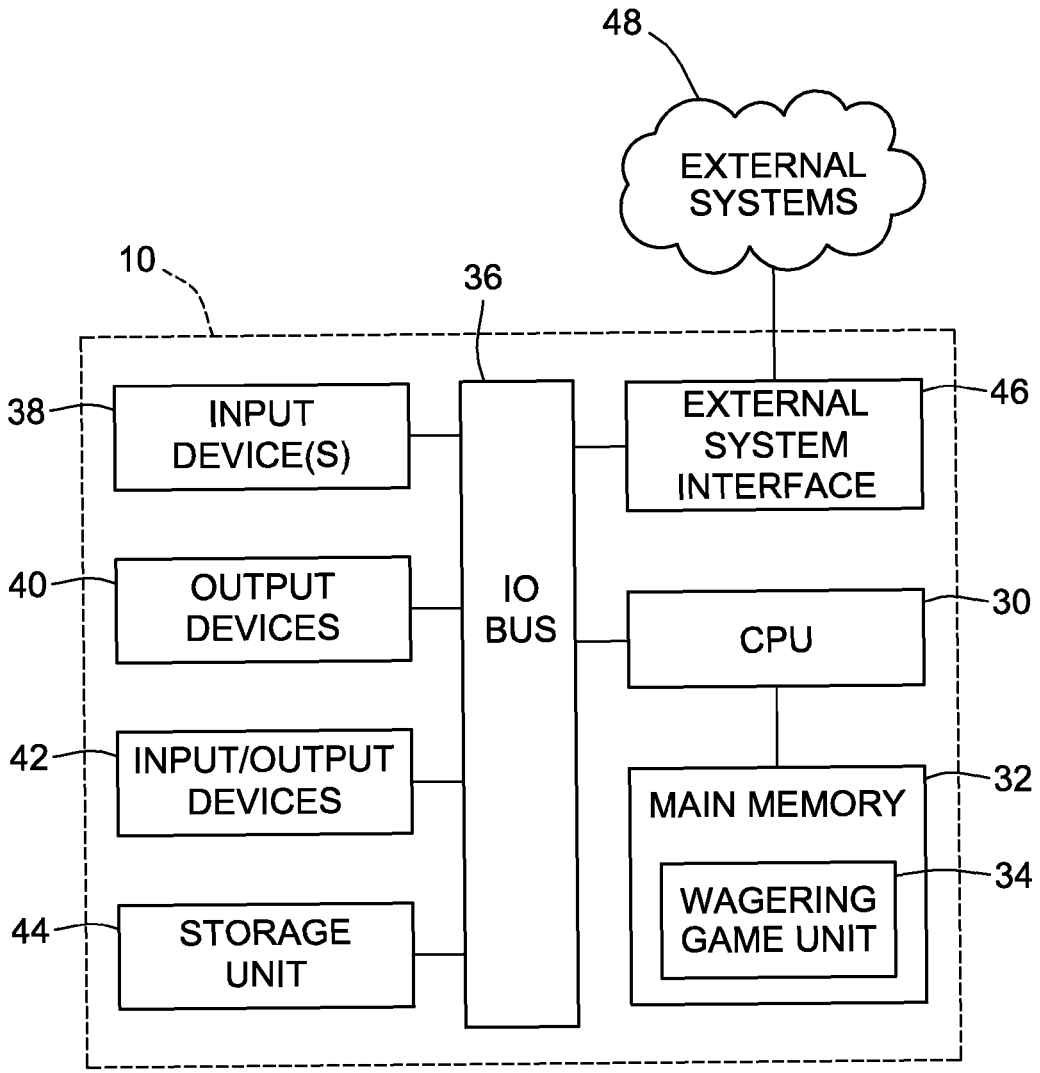
FIG. 2 is a schematic view of a gaming system according to some aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
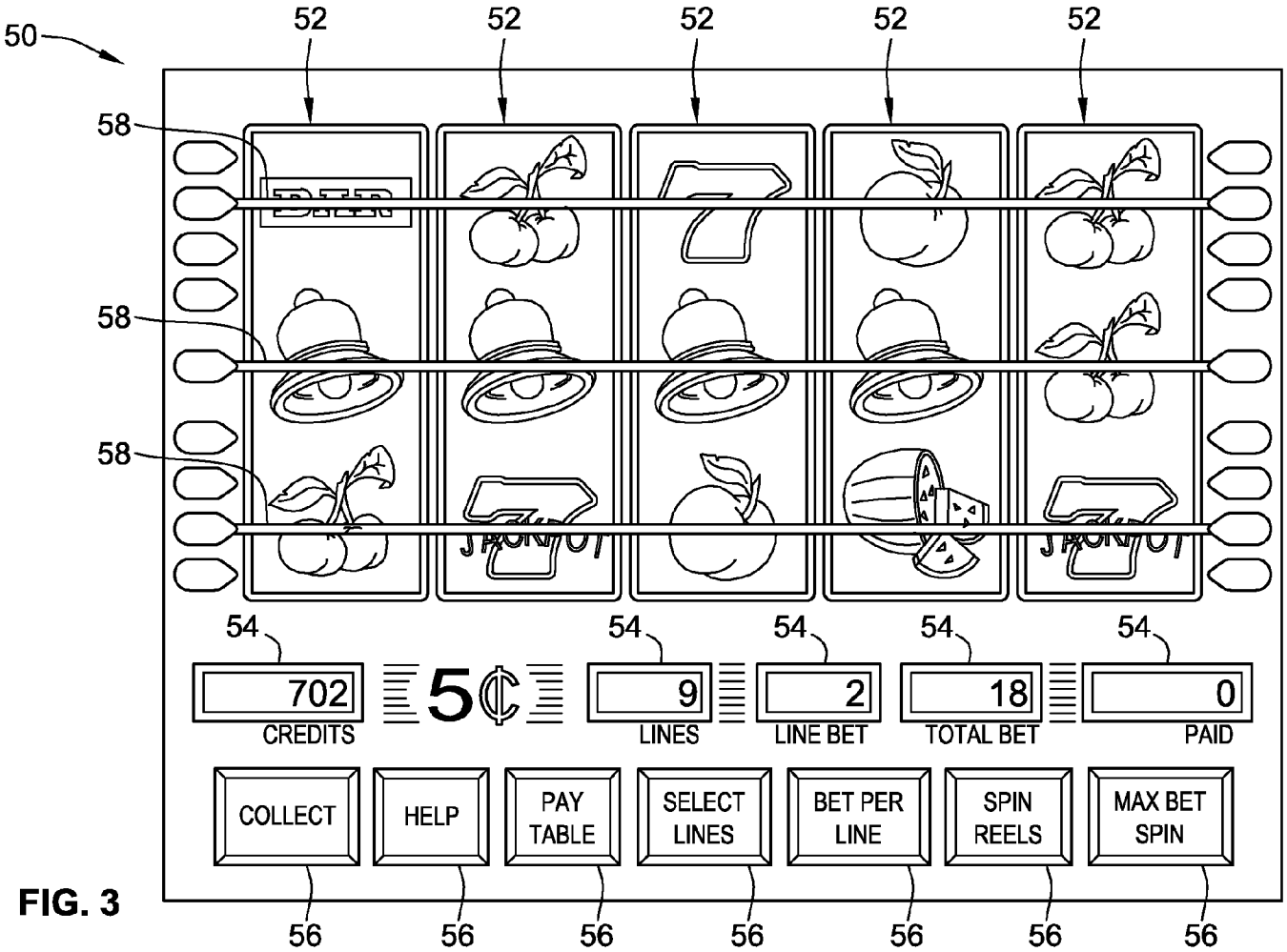
FIG. 3 is an image of an exemplary basic-game screen of a wagering game displayed on a gaming terminal according to some aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
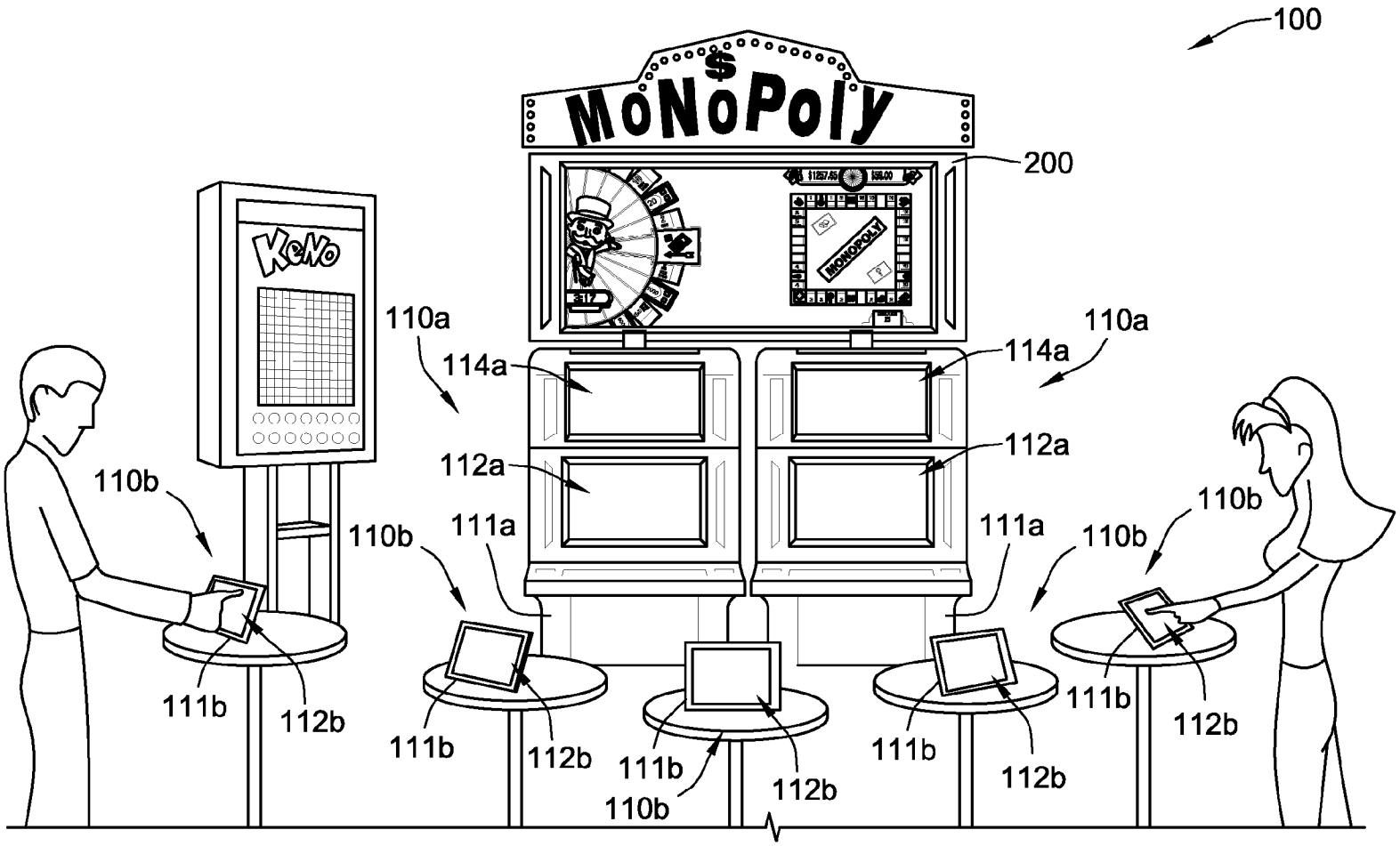
FIG. 4 is perspective view of a gaming system according to some aspects of the present disclosure.

Referring to FIG. 4, a gaming system 100 includes gaming terminals 110*a* of a first type, gaming terminals 110*b* of a second type, a community display device 200, and a gaming server (not shown). The first type of gaming terminals 110*a* are thick clients and the second type of gaming terminals 110*b* are thin clients. By thick client, as described above, it is meant that a housing 111*a* of each of the first type of gaming terminals 110*a* includes an RNG, game logic, and game assets therein (e.g., the RNG, game logic, and game assets are onboard). By thin client, as described above, it is meant that a housing 111*b* of each of the second type of gaming terminals 110*b* does not include (e.g., lacks) an RNG, game logic, and pre-stored game assets therein (e.g., the RNG, game logic, and game assets are external). The game logic and the game assets can be downloaded to the gaming terminals 110*b* in real time or just prior to being displayed on the gaming terminals 110*b*, but they do not reside there except temporarily to support real-time functions of a wagering game displayed on the gaming terminals 110*b*. In some implementations, the game assets can be buffered to the gaming terminals 110*b*. By "lacking" game logic or game assets, it is meant that game assets are not stored on the gaming terminals 110*b* until requested by a web browser of the gaming terminals 110*b*. As those of ordinary skill in the art understand, when data is downloaded from a server to a client, it resides on the client at least temporarily (e.g., in buffered form), but the data originates from the server where it is stored. When the downloaded data is no longer needed by the requesting web page, it can be discarded or overwritten.

Each of the gaming terminals 110*a* of the first type can be a floorstanding gaming terminal, such as, for example, the gaming terminal 10 described above (e.g., free-standing gaming terminal). Each of the gaming terminals 110*b* of the second type can be a handheld device, such as, for example, a personal computer (e.g., laptop), a tablet computer (e.g., IPAD tablet computer, EEE PAD tablet computer, KINDLE tablet computer, etc.), and/or a smart phone (e.g., IPHONE smart phone, SAMSUNG GALAXY smart phone, etc.). In some implementations, the gaming terminals 110*a* of the first type are primarily dedicated to wagering games and/or for playing wagering games thereon, whereas, the gaming terminals 110*b* of the second type are not primarily dedicated to wagering games and/or for playing wagering games thereon.

In some implementations, the manufacturer of the gaming terminals 110*b* of the second type is not affiliated with the manufacturer of the gaming terminals 110*a* of the first type and/or the provider of the wagering game (e.g., software) played/executed thereon. Further, in an implementation of the gaming system 100 in a gaming establishment such as a casino, whereas the gaming terminals 110*a* of the first type can be supplied by the casino, one or more of the gaming terminals 110*b* of the second type can be independently owned and operated and/or brought into the casino by an individual patron of the casino.

Additionally, the gaming terminals 110*b* of the second type can differ from the gaming terminals 110*a* of the first type in that the gaming terminals 110*b* of the second type require the player to sign in or log into an account to play a wagering game thereon, whereas the players of the gaming terminals 110*a* of the first type do not necessarily need to sign in or log into an account to play a wagering game thereon.

The gaming terminals 110*b* of the second type can include an image capturing device (e.g., a camera) for capturing a QR code (e.g., quick response code). The QR code can be displayed (e.g., on a video display or on a printed medium) near the gaming system 100, on a housing 111*a* of one of the gaming terminals 110*a* of the first type, elsewhere in a building housing the gaming system 100 (e.g., casino), or anywhere viewable to a potential player of a wagering game. Once captured, the gaming terminals 110*b* of the second type can decode the QR code and launch responsive software (e.g., a web browser) and direct the player to a specific menu and/or website. For example, in response to capturing a QR code, the gaming terminals 110*b* of the second type can display a menu of wagering games (e.g., basic wagering games, community games, side games, etc.), from which the player can select and play. The wagering games can be hosted by the gaming terminals 110*a* of the first type or by a remote (i.e., remote from the gaming terminals 110*a* and 110*b*) host or gaming server, such as represented by the external systems 48 shown in FIG. 2, or a combination of both. The QR code can encode, for example, a uniform resource locator that directs a web browser to a web page that includes the menu of wagering games or directly to a wagering game landing page.

While the gaming terminals 110*b* of the second type are shown as being proximate to the gaming terminals 110*a* of the first type (e.g., within 10-15 feet), the gaming terminals 110*b* can be positioned anywhere (e.g., anywhere within a casino housing the gaming system 100, remote from a casino housing the gaming terminals 110*a*, etc.).

The community display device 200 is generally positioned above the gaming terminals 110*a* of the first type such that a community game displayed thereon can be readily viewed by players of all of the gaming terminals 110*a* and 110*b* in the viewing vicinity of the community display device 200. The community display device 200 can be a single display device (e.g., one plasma video display) or multiple (e.g., two, three, four, etc.) display devices coupled together for displaying the community game thereon.

The gaming server (not shown) is communicatively connected (e.g., directly or indirectly) via one or more communication links (e.g., wired connection, wireless connection, both, etc.) to each of the gaming terminals 110*a*, each of the gaming terminals 110*b*, and the community display device 200. The communication links can be permanent and/or established by the gaming server. For example, if a new gaming terminal 110*b* of the second type (e.g., a new tablet computer) enters a predetermined range of the gaming system 100, the gaming server can be configured to establish a communications link (e.g., wireless) therewith. In some implementations, prior to establishing a communication link between the server and one of the gaming terminals 110*b* of the second type, the gaming terminal 110*b* must (i) join and/or connect to a wireless network of the server (e.g., a WIFI network broadcast by the server), (ii) direct its internet browser to a particular URL, (iii) activate an application thereon (e.g., launch an app), or any combinations thereof.

The gaming server can be physically integrated with one of the gaming terminals 110*a* of the first type. For example, the gaming server can be included in the housing 111*a* of one of the gaming terminals 110*a* of the first type. Alternatively, the gaming server can be located remote from the gaming terminals 110*a*, 110*b* (e.g., in a different room or area of a casino, in a different state or country, etc.).

The gaming server includes one or more RNGs, game logic, and game assets for any of the wagering games disclosed herein, including the community game. Specifically, the gaming server can act like a thick client that uses the one or more RNGs to generate random numbers, game logic for determining outcomes based on the randomly generated numbers, and game assets (e.g., images, animations, audio files, etc.) for presenting the determined outcome to players in an audio-visual manner. The presenting of the determined outcomes is not displayed on the gaming server, but, rather the determined outcomes and/or game assets are electronically transferred to one or more gaming terminals for display thereon. For example, an outcome determined by the gaming server can be transferred to and displayed on one or more of the gaming terminals 110*b* of the second type.

The gaming system 100 provides one or more games for a multitude of players to play via the gaming terminals 110*a*, 110*b*. Each of the games on each of the gaming terminals 110*a* and 110*b* can include one or more underlying or basic wagering games (e.g., slots/reels games, card games, keno games, etc.), one or more underlying or basic non-wagering games (e.g., non-wagering slots/reels games, non-wagering card games, non-wagering keno games, etc.), one or more bonus games (e.g., free spins on a slots/reels game, etc.), one or more community games (e.g., a Big Event game), or a combination thereof. The term underlying wagering games refers to games that permit a player to play in response to the player making a wager (e.g., a wager of credits or money). The term underlying non-wagering games refers to games that permit a player to play without having to make a wager (e.g., a wager of credits or money).

Figure 5:
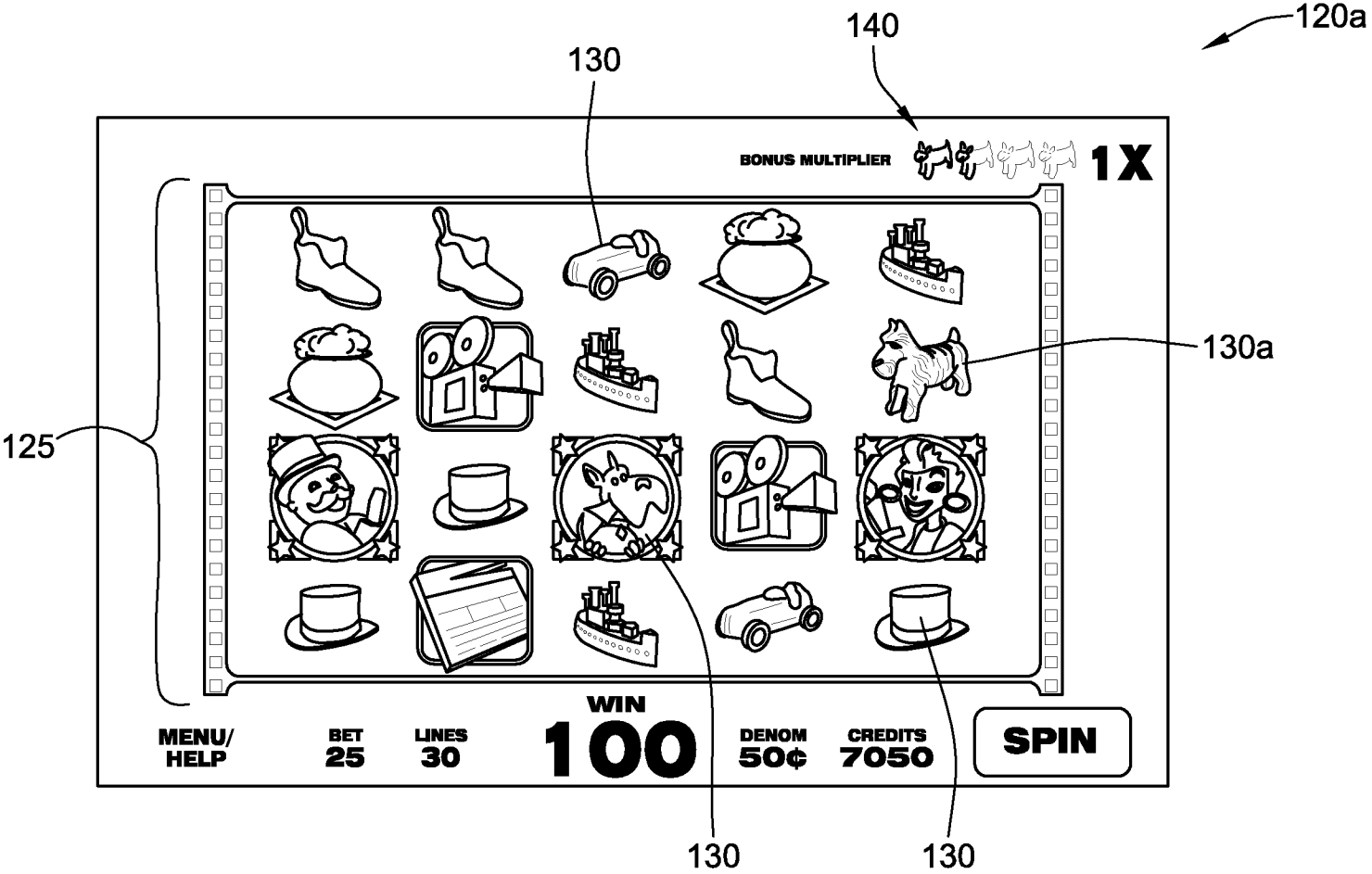
FIG. 5 is a screen shot of a display of a free-standing gaming terminal of the gaming system of FIG. 4.

Each of the gaming terminals 110*a* includes a primary display area 112*a* and a secondary display area 114*a*, and each of the gaming terminals 110*b* includes a display area 112*b*. The primary display area 112*a* and/or the secondary display area 114*a* of the gaming terminals 110*a* and the display area 112*b* of the gaming terminals 110*b* can be used for displaying one or more portions of a wagering game and/or a non-wagering game. As shown in FIG. 5, an example screen shot 120*a* of the primary display area 112*a* and/or the secondary display area 114*a* of a first one of the gaming terminals 110*a* of the first type (hereinafter referred to as "the first gaming terminal 110*a*") illustrates one play of a slots-type basic wagering game according to some aspects of the present disclosure.

The screen shot 120*a* includes an array of symbol positions 125 that can used in conducting the wagering game. The array of symbol positions 125 is a 4×5 matrix of symbol positions arranged in five columns and four rows (i.e., twenty symbol positions). The array of symbol positions 125 is formed by a plurality of symbol-bearing reels such that each of the columns is occupied by a single one of the reels and each of the reels bears at least a portion of a plurality of symbols 130. The symbol bearing reels can be mechanical reels, displayed simulated reels, or a combination thereof. While the array of symbol positions 125 is shown as including five columns and four symbol positions per column (i.e., four rows of symbol positions), any number of columns and rows can be provided. For example, the array of symbol positions can include 1, 2, 3, 4, 10, 20, n, etc. columns with 1, 2, 3, 4, 10, m, etc. rows.

While the first gaming terminal 110*a* conducts a play of the wagering game, each of the columns of the array of symbol positions 125, or each of the symbol-bearing reels, spins or illustrates a simulated spin (not shown) to appear as if each of the columns is spinning prior to displaying an outcome of symbols (FIG. 5). At the beginning of a first play of the basic wagering game, all of the columns spin and then stop spinning in a predetermined order (e.g., the first column stops spinning first and displays its outcome, then the second column stops and displays its outcome, etc.). As each column stops spinning, a portion of a randomly selected outcome of symbols is displayed on the primary display area 112*a* and/or the secondary display area 114*a*, until the entire outcome is displayed, as shown in FIG. 5.

Once the reels stop spinning and the outcome is displayed (FIG. 5), the outcome is evaluated to determine if it is a winning outcome. For example, an outcome of the wagering game is a winning outcome if it includes an award of winning symbols or at least one other type of award, such as a multiplier. An outcome can include multiple awards awarded to different players, for example to players of a wagering game being conducted on any of the gaming terminals 110*a* and to players of a wagering game being conducted on any of the gaming terminals 110*b*. In order for a symbol to be a winning symbol, and thus, contributing to the outcome being a winning outcome, the symbol must be part of one or more combinations of symbols on one or more lines of the wagering game, which correspond with one or more respective winning combinations of symbols included in a paytable of the wagering game. The paytable associates each possible winning combination, for the wagering game, with an award (e.g., credits) that is provided to the player of the wagering game once that winning combination is achieved. Thus, a winning outcome can include multiple combinations of symbols that correspond with respective winning combinations of symbols in the paytable. By the term line of the wagering game it is meant to include "paylines" in payline related wagering games and "ways" in any pay or any way related wagering games.

In addition to the outcome being evaluated to determine if it is a winning outcome, the outcome can be evaluated to determine if the outcome includes one or more special symbols 130*a*. The special symbols 130*a* appearing as part of an outcome of the basic wagering game can be collected by a player to increase the player's bonus multiplier for use in a community game. Each collected special symbol 130*a* increases the multiplier value by one unit. Each unit can increment the multiplier by an integer number (e.g., one or two, etc.) or a fraction of an integer number (e.g., ¼, ½, etc.). In the case of the multiplier including a faction (e.g., achieved multiplier is 1.25× or 2.7×) when the community game is triggered, the multiplier value used during play of the community game is rounded down (e.g., achieved multiplier of 1.25× is used as a multiplier of 1×).

As shown in the outcome of FIG. 5, the symbol position second from the top in the fifth column of the array of symbol positions 125 is associated with a special symbol 130*a*. In the illustrated example, the special symbol 130*a* is a dog-token symbol; however, the special symbol can be any other type or kind of symbol. The player's progress of collecting the special symbols 130*a*—to achieve a multiplier for use during the community game—during play of the basic wagering game is shown in the multiplier area 140 of the screen shot 120*a*. As shown, the player has achieved a 1× multiplier thus far and is still working on collecting additional special symbols 130*a* to achieve the next multiplier level (e.g., a 2× multiplier).

The players of the gaming terminals 110*a* can continue playing the basic wagering game by spinning and re-spinning the reels of the basic wagering game to try and win additional credits (e.g., corresponding to and redeemable for real money) and to increase their respective multiplier prior to the community game being triggered. The community game can be triggered by the gaming server, by one of the gaming terminals 110*a* of the first type, or a combination thereof. The community game is triggered for the players of the gaming terminals 110*a* periodically (e.g., every three, four, five, etc. minutes). That is, the community game is triggered (e.g., starts to be conducted) at a set interval of time (e.g., every four minutes). Alternatively, the community game can be triggered randomly as a mystery trigger (e.g., based on a RNG), in response to a player of the wagering game achieving a predetermined trigger outcome, etc.

After the community game is triggered, a determination is made as to which players of the gaming terminals 110*a*, 110*b* are eligible to join and play the community game. The determination of eligibility can be made by the gaming server, by one or more of the gaming terminals 110*a* of the first type, or a combination thereof. The players of the gaming terminals 110*a* of the first type are eligible to join the triggered community game if an eligibility criterion (e.g., a first eligibility criterion) is satisfied. The eligibility criterion can be, for example, whether a player is actively playing the underlying wagering game in a time period prior to the community game being triggered. The eligibility criterion can further include, for example, whether the player is actively playing the underlying wagering game in a time period prior to the community game being triggered at a predetermined rate of coin-in. For another example, the eligibility criterion can be whether a player collected a predetermined number (e.g., one, two, etc.) of special symbols (e.g., special symbols 130*a*) prior to the community game being triggered. For yet another example, the eligibility criterion can be whether a player has collectively spent a predetermined amount of credits during play of the basic wagering game prior to the community game being triggered.

Similarly, the players of the gaming terminals 110*b* of the second type are eligible to join the triggered community game if an eligibility criterion (e.g., a second eligibility criterion that is different than the first eligibility criterion) is satisfied. For example, the eligibility criterion for the players of the gaming terminals 110*b* of the second type is whether the player purchased eligibility to play the community game by, for example, placing one or more side wagers prior to the community game being triggered. In some implementations, the players of the gaming terminals 110*b* of the second type can gain instant eligibility for the community game with the placing of a side wager as the act of placing a side wager itself permits the players to participate in the community game.

Once a determination has been made that one or more of the players of the gaming terminals 110*a*, 110*b* are eligible to play the community game, the community game is conducted by displaying the community game and its outcome on the community display device 200 and/or on the display area 112*b* of the gaming terminals 110*b*. In some implementations, the community game, its outcome, representations of the outcome, or any portion thereof can be displayed on the primary and/or the secondary display areas 112*a*, 114*a* of the gaming terminals 110*a*, the display area 112*b* of the gaming terminals 110*b*, the community display device 200, or any combinations thereof.

Figure 8:
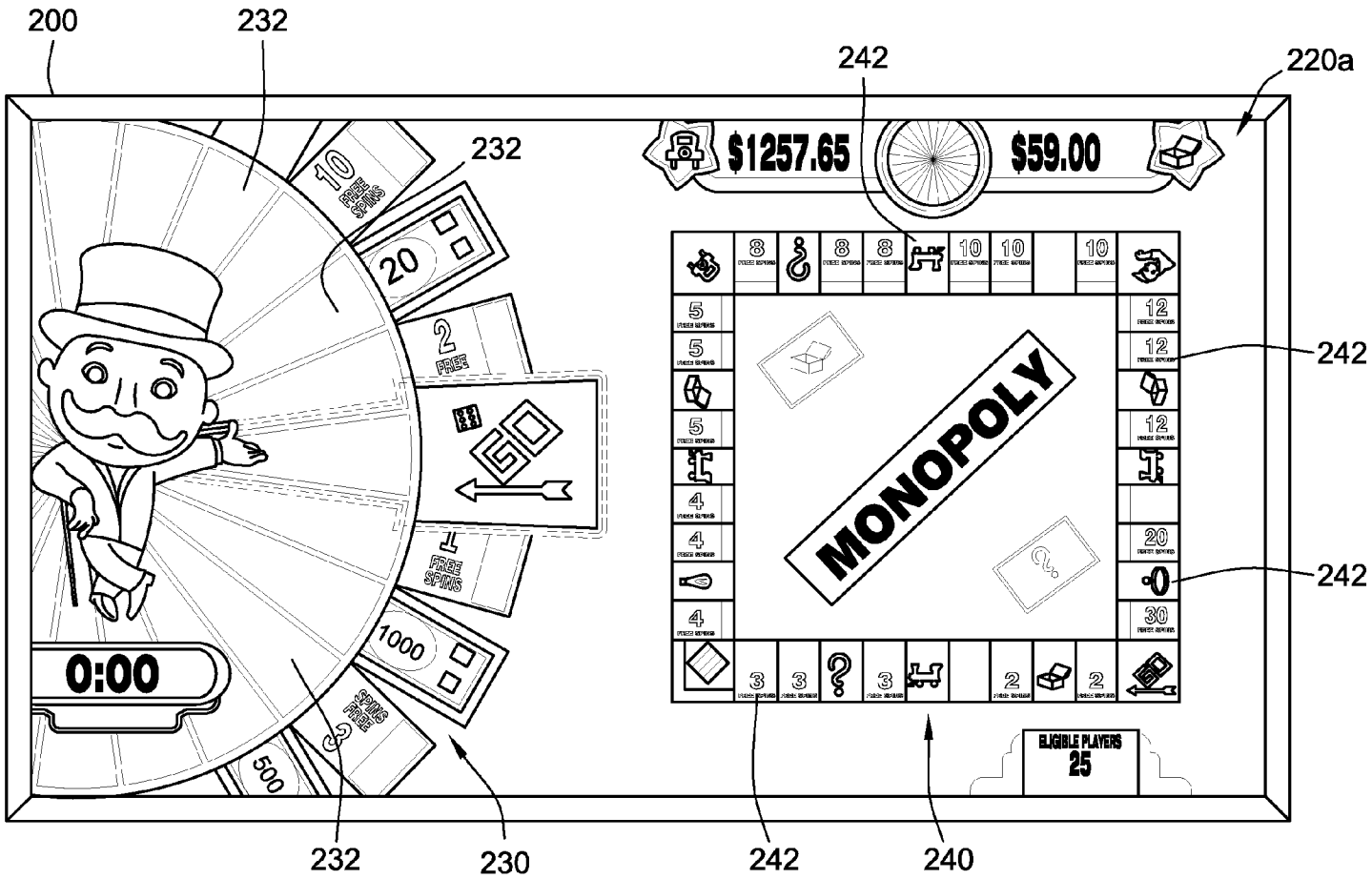
FIG. 8 is a screen shot of a community display of the gaming system of FIG. 4 illustrating some aspects of a community game.

Generally, as shown in FIG. 8, the community game includes a wheel 230 (e.g., a virtually spinning wheel) and a board 240 (e.g., a MONOPOLY themed board). The wheel 230 has a plurality of sections or slices 232. Each of the sections 232 is associated with a position 242 of the board 240 (e.g., Boardwalk, Go, Free parking, etc.) or a bill (e.g., 20 dollar bill, 500 dollar bill, etc.). Additionally, awards are associated with each of the sections 232 and/or each of the positions 242. For the sections 232 that are associated with a position 242 of the board 240, the award can be free plays or spins of a reel bonus game or a trigger to a Once-Around-Bonus aspect. For the sections 232 that are associated with a bill, the award can be credits (e.g., a 20 dollar bill can be associated with an award of twenty credits, etc.).

Figure 6:
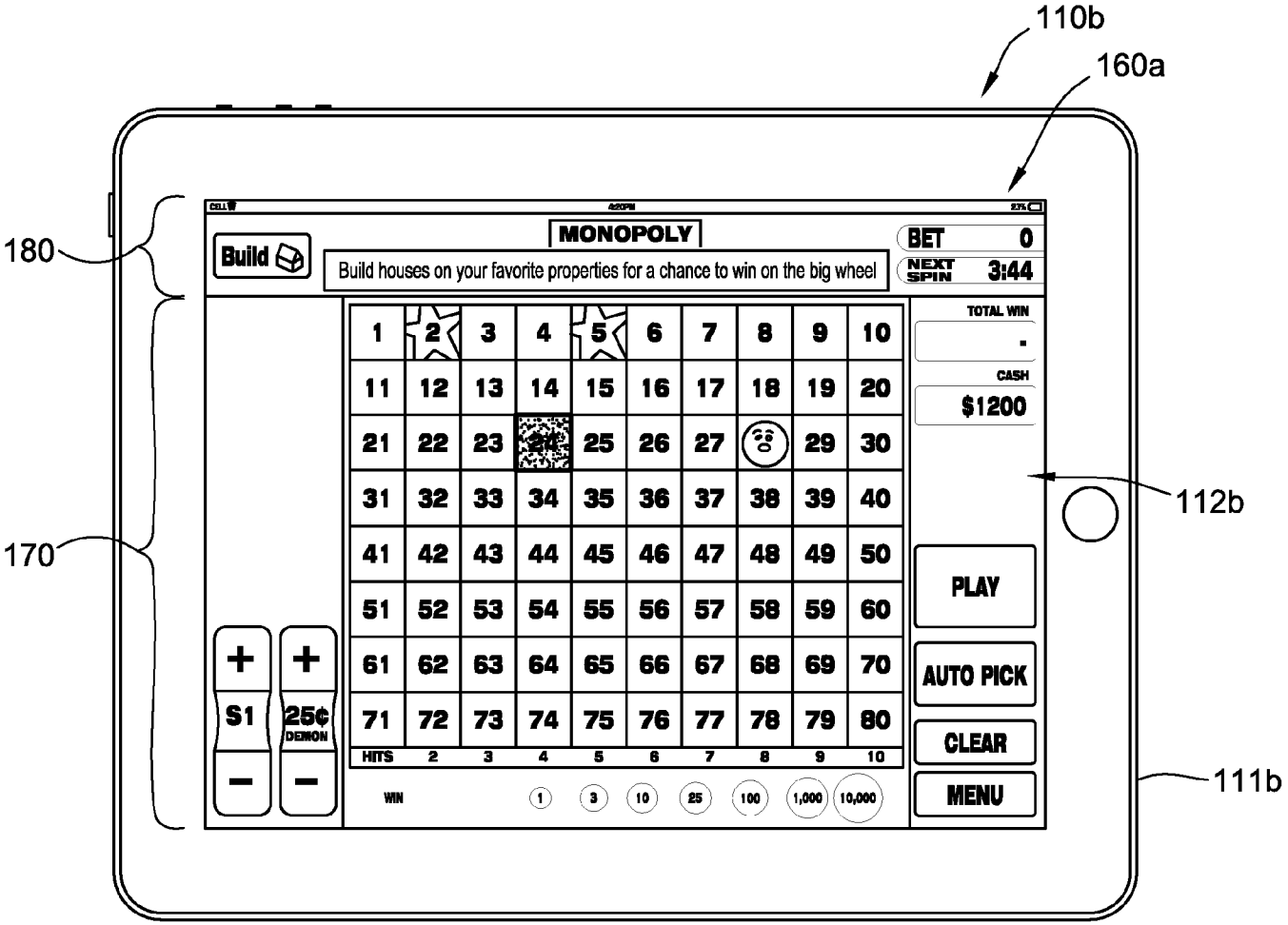
FIGS. 6 and 7 is a screen shot of a display of a portable gaming terminal of the gaming system of FIG. 4.

As shown in FIG. 6, a screen shot 160*a* of the display area 112*b* of a first one of the gaming terminals 110*b* of the second type (hereinafter referred to as "the second gaming terminal 110*b*") illustrates a keno-type basic wagering game 170 and a side-wager or side-game bar 180 (e.g., dropdown menu). The keno-type basic wagering game 170 can be played by a player according to known methods for playing keno. Alternatively, the keno-type basic wagering game 170 can be any other type of basic wagering game (e.g., slots type, card type, etc.). The screen shot examples on the gaming terminals 110*b* discussed herein can be portrayed on a web page displayed by a web browser running on any of the gaming terminals 110*b*, for example.

In some implementations, the keno-type basic wagering game 170, played on the gaming terminals 110*b* of the second type, is a slow playing wagering game (e.g., low or slow coin-in wagering game) as compared to a slots-type wagering game that is a relatively faster playing wagering game (e.g., high or fast coin-in wagering game). Thus, players of low coin-in wagering games typically spend less credits (e.g., money) over a set period of time as compared to players of high coin-in wagering games. In some alternative implementations, the keno-type basic wagering game 170 can be a non-wagering game. That is, players of the gaming terminals 110*b* of the second type can play only non-wagering games prior to joining the community game as described herein.

The side-wager bar 180 provides information about the community game (e.g., the same community game playable by the players of the gaming terminals 110*a*) and provides access for the player of the second gaming terminal 110*b* to join the community game according to some aspects of the disclosed concepts. To be eligible to participate in the community game, the player of the second gaming terminal 110*b* first activates the side-wager bar 180 and then purchases eligibility to participate in the community game by, for example, placing one or more side wagers. The side-wager bar 180 can be activated by, for example, touching a portion of the side bar 180 (e.g., pressing the side-wager bar 180 with a fingertip and sliding the fingertip downward). Once activated, the side-wager bar 180 extends to cover all of, or a major portion of, the display area 112*b*.

As noted herein, the eligibility requirement for participating in the community game is different for players of the gaming terminals 110*a* versus players of the gaming terminals 110*b*. That is, the community game has varying eligibility requirements. In this example, players of the gaming terminals 110*b* must directly purchase their eligibility to participate in the community game, whereas players of the gaming terminals 110*a* need not, but rather attain participation eligibility by satisfying a different criterion. In some implementations, for example, eligibility to play the community game for a first player of one of the gaming terminals 110*a* of the first type is dependent upon the first player playing an underlying wagering game (e.g., placing wagers to play a wagering game), whereas eligibility to play the community game for a second player of one of the gaming terminals 110*b* of the second type is not dependent upon the second player playing an underlying wagering game (e.g., the second player can play a non-wagering game or no game at all on the gaming terminal 110*b* prior to being permitted to play the community game).

By the term "dependent upon" it is meant that in order for the player of the first gaming terminal 110*a* to play the community game, the player must be playing an underlying wagering game (e.g., a slots-type wagering game) prior to the triggering of the community game. By "playing" it is meant that the player is placing (or has placed) one or more wagers on the underlying wagering game. Thus, for example, suppose a player of the first gaming terminal 110*a* placed twenty wagers (ranging from 10 to 100 credits) over the course of three minutes immediately prior to the triggering of the community game. In such an example, the player is considered to be playing the underlying wagering game and thus eligible to play the community game. Of course, requirements in addition to playing an underlying wagering game for gaining eligibility to play the community game can be implemented as described herein (e.g., collecting special symbols, playing the underlying wagering game at a predetermined rate of coin-in, etc.).

By the term "not dependent upon" it is meant, for example, that the player of the second gaming terminal 110*b* does not have to play an underlying wagering game prior to the triggering of the community game in order for the player to be able to play the community game. Thus, the player can simply be playing an underlying non-wagering game, browsing the internet, or simply waiting for the community game to be conducted immediately prior to the triggering of the community game. Alternatively, the player of the second gaming terminal 110*b* can be playing an underlying wagering game immediately prior to the triggering of the community game. Thus, for example, suppose a player of the second gaming terminal 110*b* browsed the internet on a web browser over the course of three minutes immediately prior to the triggering of the community game. In such an example, the player is not playing an underlying wagering game; yet, the player can still be eligible for playing the community game. Of course, affirmative requirements for gaining eligibility to play the community game can be implemented as described herein (e.g., placing one or more side wagers, etc.). In fact, in some implementations, players of the gaming terminals 110*b* of the second type can gain instant eligibility to play the community game by making such side wagers.

Figure 7:
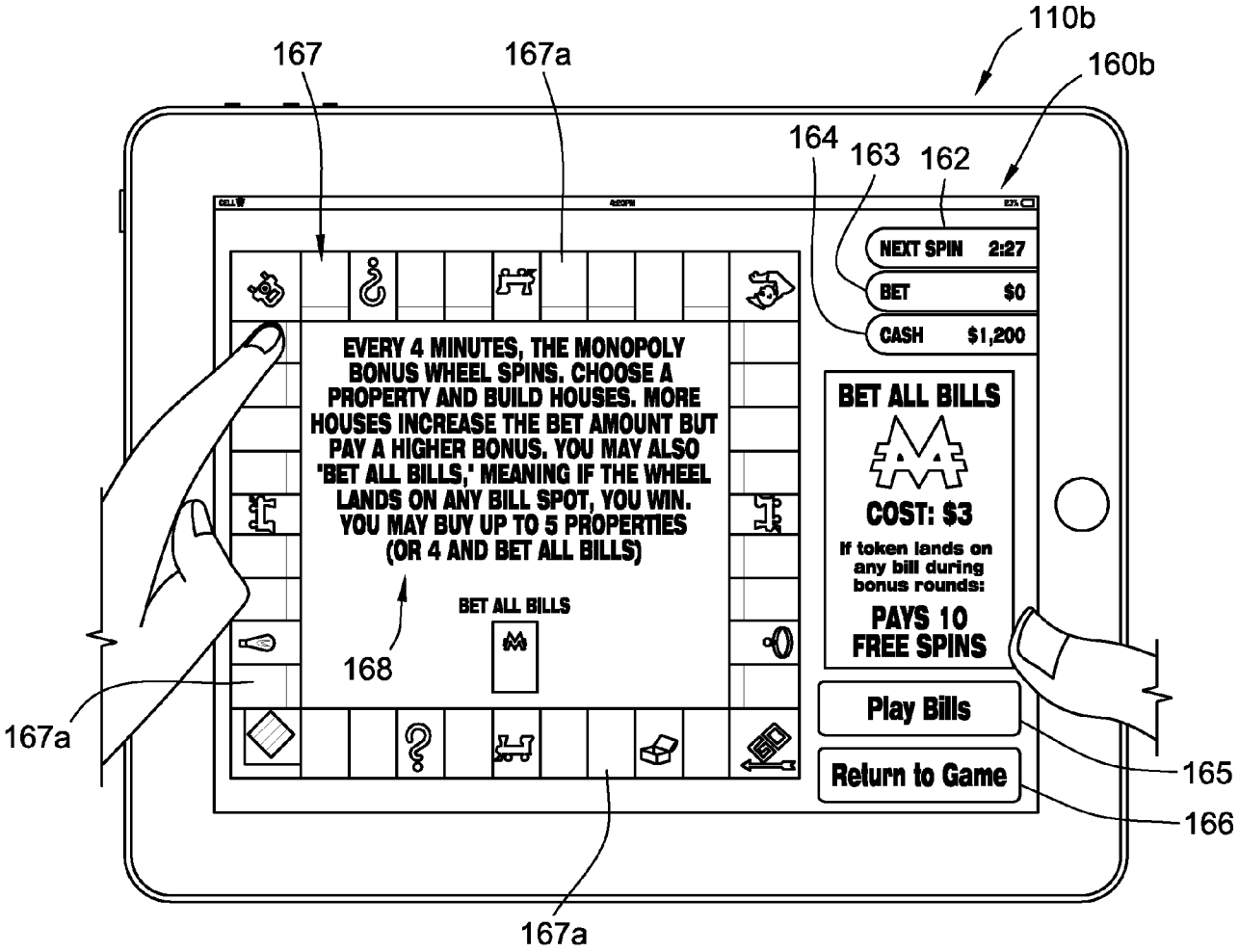

As shown in FIG. 7, a screen shot 160*b* illustrates some aspects of the community game once the side-wager bar 180 is activated on the second gaming terminal 110*b*. The aspects of the community game illustrated in the screen shot 160*b* include a countdown timer 162 that indicates when the next play of the community game will occur. As shown, the next play (e.g., spin of a wheel 230, shown in FIG. 8) will occur in two minutes and twenty-seven seconds. Thus, the player of the second gaming terminal 110*b* has just under two and a half minutes to join the community game by purchasing eligibility (e.g., placing one or more side wagers).

Some of the other aspects of the community game illustrated in the screen shot 160*b* include a wager amount meter 163, a cash amount meter 164, a play bills selectable element 165, a return to game selectable element 166, a board representation 167 of the board 240 (shown in FIG. 8), and instructions 168. The wager amount meter 163 indicates the amount of side wagers placed on one or more of the positions 242 (shown in FIG. 8) of the board 240. For example, by following the instructions 168, a player can select a first representative board position 167*a* (e.g., corresponding to a position 242 on the board 240 shown in FIG. 8) that is associated with a property (e.g., Mediterranean Ave.) and place a side wager thereon (e.g., 2 dollars) and the wager amount meter 163 will indicate that a total wager of 2 dollars has been made by the player of the second gaming terminal 110*b*.

The cash amount meter 164 indicates the amount of cash or credits in an account of the player of the second gaming terminal 110*b*. In some implementations, the player of must log in or sign into the account for the account value or credits to appear in the cash amount meter 164. As the player makes side wagers on the positions 242 of the board 240 (e.g., by selecting the representative board positions 167*a* and placing side wagers), the amount of cash indicated by the cash amount meter 164 decreases accordingly. Similarly, after the player wins one of the side wagers placed on a position 242 (e.g., if the side wager is made on a position that is randomly chosen as a winning position during play of the community game), any award in cash and/or credits achieved is reflected by the cash amount meter 164.

The play bills selectable element 165 is a softkey button that can be selected and/or pressed by the player of the second gaming terminal 110*b* to place a side wager on some or all of the sections 232 of the wheel 230 associated with a bill. Thus, the play bills selectable element 165 provides a convenient way to place side wagers one or multiple potential winning sections 232 of the wheel 230.

If the player of the second gaming terminal 110*b* does not want to participate in the community game or if the player is done making side wagers, the player can exit the community game and continue to play the keno-type basic wagering game 170 (or any other type of basic wagering game) by selecting and/or pressing the return to game selectable element 166 (e.g., returning from the screen shot 160*b* of FIG. 7 to the screen shot 160*a* of FIG. 6).

As mentioned above, the board representation 167 is a representation (e.g., a graphical and/or virtual reproduction) of the board 240 of the community game shown in FIG. 8. The board representation 167 includes a plurality of representative board positions 167*a* that correspond to positions 242 on the board 240. Thus, a side wager made by the player on a representative board position 167*a* results in a side wager being made on the board 240 on the corresponding position 242.

The instructions 168 provide a quick reference for the player of the second gaming terminal 110*b* to make side wagers. Various other types of instructions can be provided. Further, the content of the instructions 168 can be different depending on the parameters of the community game implemented.

Referring to FIG. 8, a screen shot 220*a* of the community display device 200 illustrates a play of the community game. The players of the second type of gaming terminals 110*b* can actively purchase eligibility to join the community game by selecting and placing side wagers on one or more of the positions 242 of the board 240 via the board representation 167 as described above (e.g., using the representative board positions 167*a*). For example, the player of the second gaming terminal 110*b* can select up to five positions 242 associated with five MONOPOLY properties (e.g., Kentucky Ave., Boardwalk, Pacific Ave., Marvin Gardens, and New York Ave.) and place side wagers thereon. By placing a side wager on a position 242 associated with a property, the player is wagering that the position 242 (with the side wager thereon) will be randomly selected as a winning position during play of the community game.

The side wagers placed by the player of the second gaming terminal 110*b* can be represented on the board 240 and/or on the board representation 167 of the community game as houses and/or hotels. The number of houses built on a particular position (e.g., property) represents the size of the side wager made by the player and the size of a multiplier associated therewith. For example, four houses built on the position 242 associated with the Boardwalk property indicates a side wager of sixteen dollars (e.g., four dollars per house) on that position with a 4× multiplier and two houses built on New York Ave. indicates a side wager of four dollars (e.g., two dollars per house) on that position with a 2× multiplier.

After the community game is triggered and the eligible players of the first type of gaming terminals 110*a* are determined and the joining players of the second type of gaming terminals 110*b* place their side wagers (e.g., the side wagers can be placed prior to or after the community game is triggered), the wheel 230 spins and one of the sections 232 is randomly selected as a winning section (e.g., Mr. Monopoly points to a winning section). At the conclusion of the community game, the award associated with the winning section is automatically provided to all eligible players of the first type of gaming terminals; however, only players of the second type of gaming terminals that placed a side wager on the position 242 of the board 240 that corresponds with the winning section 232 of the wheel 230 are provided with the award associated with the winning section 232.

For example, if the player of the second wagering terminal 110*b* built two houses on the position 242 associated with the Mediterranean Ave. property, thereby placing a side wager of two dollars (e.g., one dollar per house) on Mediterranean Ave., and the section 232 of the wheel 230 associated with Mediterranean Ave. is selected as the winning section of the community game, then the player of the second gaming terminal 100*b* will be provided with the award (e.g., two free plays of a reel bonus game) at a 2× multiplier level, for a total of, for example, four free plays of the reel bonus game. However, if the player of the second wagering terminal 110*b* built four houses on Boardwalk, thereby placing a side wager of sixteen dollars (e.g., four dollars per house) on Boardwalk, and the section 232 of the wheel 230 associated with Mediterranean Ave. is selected as the winning section of the community game, then the player of the second gaming terminal 110*b* will not be provided with the award (e.g., two free plays of a reel bonus game) at a 4× multiplier level, because the player of the second wagering terminal 110*b* failed to place a side wager on a position 242 that corresponds with the randomly selected winning section 232 (which in this example is Mediterranean Ave. and not Boardwalk).

However, players of the wagering terminals 110*a* of the first type that are determined to be eligible for playing the community game (e.g., the player was actively playing the underlying wagering game when the community game was triggered), will receive the awards associated with the randomly selected winning sections 232 at their respective multiplier level regardless of what properties are associated with side wagers placed by players of the second type of gaming terminals 110*b*. That is, players of the gaming terminals 110*a* do not need to place side wagers on the positions 242 of the community game in order to be eligible to play and win award(s) associated with the community game. Thus, in the above example, all eligible players of the gaming terminals 110*a* would be provided with the award associated with the winning section 232 (e.g., Mediterranean Ave.) at their respective multiplier level.

According to some implementations of the community game, one of the sections 232 of the wheel is associated with a Once-Around-Bonus trigger (e.g., the Go position). In such implementations, if the section 232 of the wheel 230 associated with the Once-Around-Bonus trigger is randomly selected as the winning section (as shown in FIG. 8), a Once-Around-Bonus aspect of the community game is conducted (e.g., played).

Figure 9A:
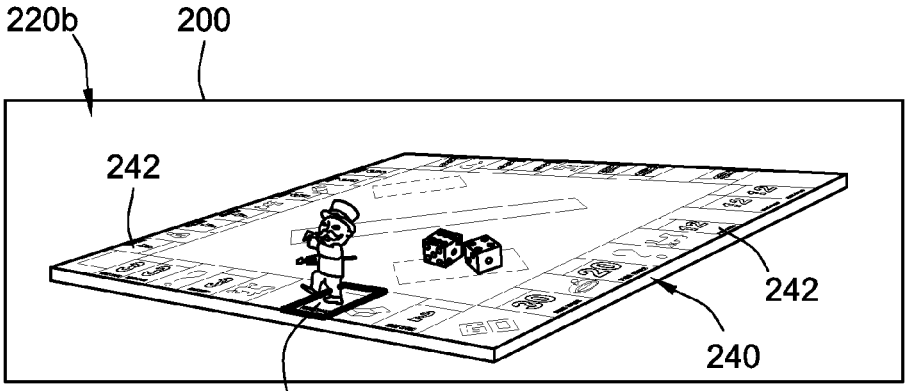
FIG. 9A is a screen shot of the community display of the gaming system of FIG. 4 illustrating some additional aspects of the community game.
Figure 9B:
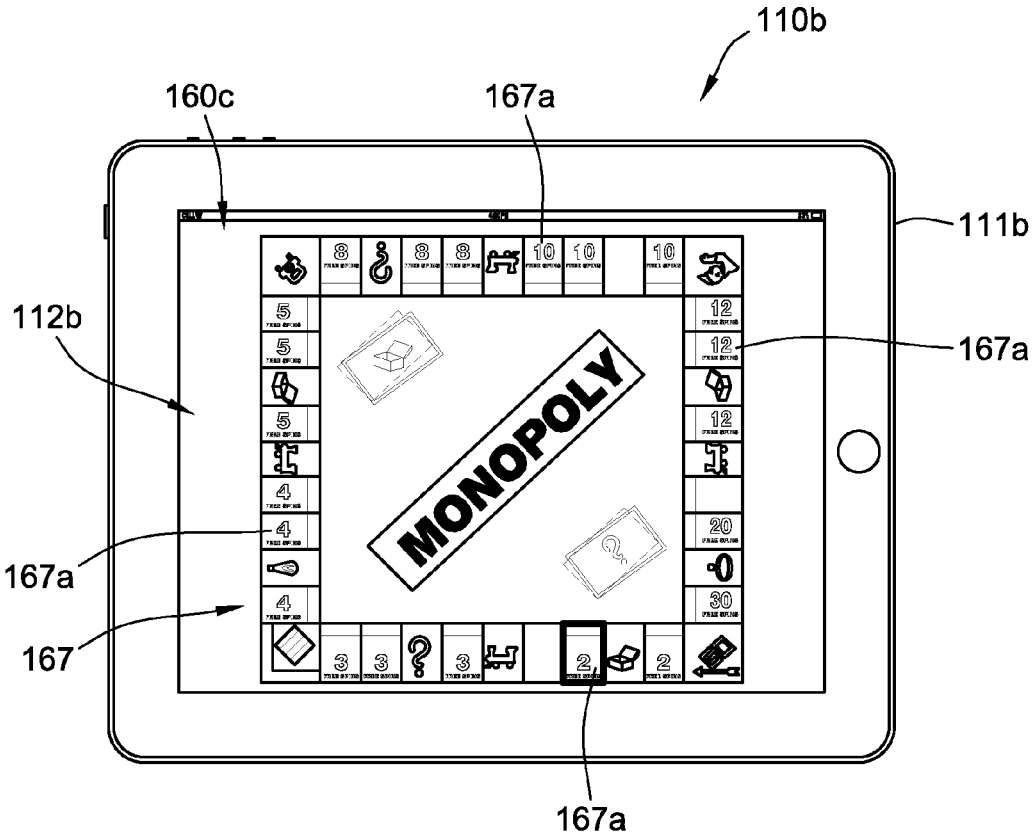
FIG. 9B is a screen shot of the display of the portable gaming terminal of the gaming system of FIG. 4*a* illustrating the community game.

After the Once-Around-Bonus aspect is triggered, the wheel 230 visually disappears and the board 240 is highlighted to the players. Specifically, the board 240 can be displayed to the players of the gaming terminals 110*a* on the community display device 200 and to the players of the gaming terminals 110*b* on the display areas 112*b*. As shown in FIG. 9A, a screen shot 220*b* illustrates the board 240 on the community display device 200 in a three-dimensional perspective view. However, as shown in FIG. 9B, a screen shot 160*c* illustrates the board representation 167 on the display area 112*b* of the second gaming terminal 110*b* in a two-dimensional top view. The Once-Around-Bonus aspect involves dice being virtually rolled and advancing a game token (e.g., Mr. Monopoly) around the board 240. Each position 242 that the game token lands upon during play of the Once-Around-Bonus aspect of the community game is randomly selected as a winning position. The Once-Around-Bonus aspect continues until the game token completes one trip around the board 240. The winning positions can be highlighted on the board 240 and/or on the board representation 167 to indicate to the players which of the positions 242 are winning positions. In some implementations, the community display device 200 displays the community game and the display areas 112*b* of the gaming terminals 110*b* of the second type display a representation of the community game, including a representation of the outcome of the community game.

At the conclusion of the Once-Around-Bonus aspect of the community game, the awards associated with each of the winning positions 242 are automatically provided to all eligible players of the gaming terminals 110*a* of the first type; however, only players of the gaming terminals 110*b* of the second type that placed a side wager on the winning positions 242 are provided the award(s) associated therewith.

For example, suppose the player of the second wagering terminal 110*b* built (i) four houses on Mediterranean Ave., thereby placing a side wager of four dollars (e.g., one dollar per house) on Mediterranean Ave., (ii) four houses on New York Ave., thereby placing a side wager of eight dollars (e.g., two dollars per house) on New York Ave., (iii) four houses on Kentucky Ave., thereby placing a side wager of twelve dollars (e.g., three dollars per house) on Kentucky Ave., (iv) four houses on Pacific Ave., thereby placing a side wager of sixteen dollars (e.g., four dollars per house) on Pacific Ave., and (v) two houses on Boardwalk, thereby placing a side wager of eight dollars (e.g., four dollars per house) on Boardwalk. Then suppose that during the Once-Around-Bonus aspect, the game token randomly selected and landed on positions 242 associated with the Oriental Ave. property, then the New York Ave. property, then the Illinois Ave. property, then the Pacific Ave. property, and then the Go property/space; where Oriental Ave. is associated with an award of three free plays of a reel bonus game, New York Ave. is associated with an award of five free plays of a reel bonus game, Illinois Ave. is associated with an award of eight free plays of a reel bonus game, Pacific Ave. is associated with an award of twelve free plays of a reel bonus game, and Go is associated with no award. The outcome of the Once-Around-Bonus aspect is then the positions 242 associated with the following properties: Oriental Ave., New York Ave., Illinois Ave., and Pacific Ave. As the player of the second wagering terminal 110*b* only placed side wagers on two of the four winning positions, only the awards associated with those two winning positions are provided to the player of the second wagering terminal 110*b*. In this example, the player of the second wagering terminal 110*b* would be awarded with five free plays of a reel bonus game at a 4× multiplier for placing the four houses on the position 242 associated with the New York Ave. property plus twelve free plays of the reel bonus game at a 4× multiplier for placing the four houses on the position 242 associated with the Pacific Ave. property for a total of sixty-eight free plays (20+48=68).

However, each of the players of the gaming terminals 110*a* of the first type that were eligible to play the community game, would be awarded with all of the awards associated with the positions 242 associated with the Oriental Ave., New York Ave., Illinois Ave., and Pacific Ave. properties at the players' respective multiplier level achieved prior to the community game being triggered. For a player of the first gaming terminal 110*a* with a multiplier of 1×, the player would be awarded with three free plays of a reel bonus game at a 1× multiplier for the game token landing on the position 242 associated with the Oriental Ave. property plus five free plays of a reel bonus game at a 1× multiplier for the game token landing on the position 242 associated with the New York Ave. property plus eight free plays of a reel bonus game at a 1× multiplier for the game token landing on the position 242 associated with the Illinois Ave. property plus twelve free plays of the reel bonus game at a 1× multiplier for the game token landing on the position 242 associated with the Pacific Ave. property for a total of twenty-eight free plays (3+5+8+12=28).

Figure 10A:
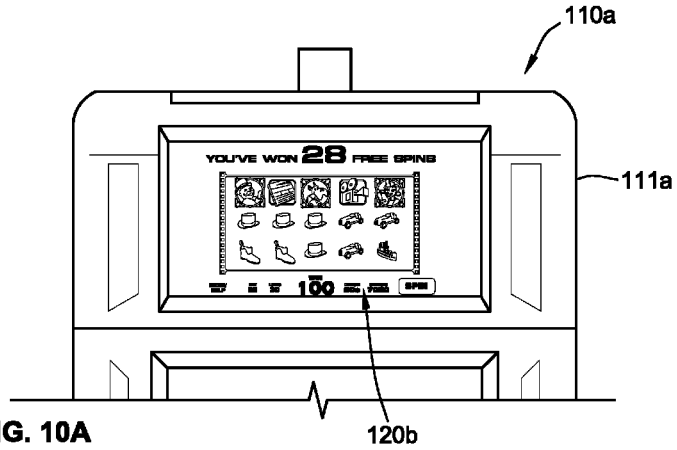
FIG. 10A is a screen shot of the display of the free-standing gaming terminal of the gaming system of FIG. 4 illustrating some additional aspects of the community game.
Figure 10B:
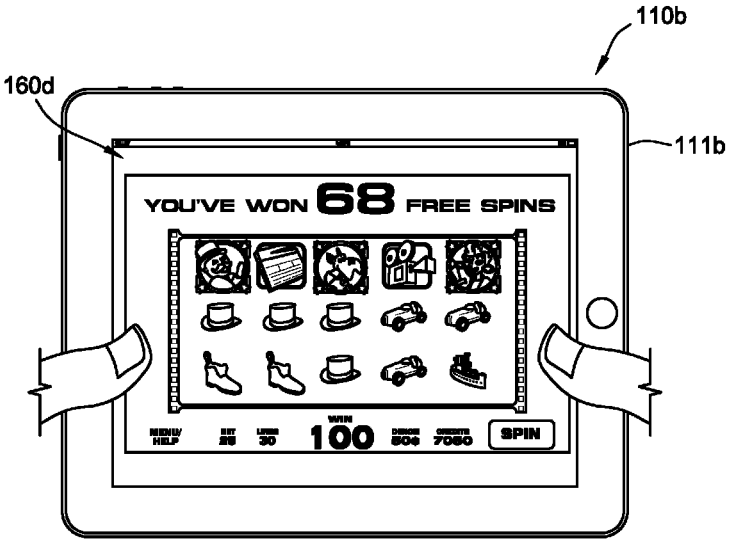
FIG. 10B is a screen shot of the display of the portable gaming terminal of the gaming system of FIG. 4 illustrating some additional aspects of the community game.

In the case that the awards determined for each eligible player in the community game include free plays of a reel bonus game, the free plays are carried out and displayed to the players. For example, in the above example, the player of the first gaming terminal 110*a* won twenty-eight free plays and the player of the second gaming terminal 110*b* won sixty-eight free plays. Thus, as shown in a screen shot 120*b* of FIG. 10A, the primary and/or secondary display area 112*a* and/or 114*a* of the first gaming terminal 110*a* displays the twenty-eight free plays and any awards (e.g., credits) associated therewith to the player of the first gaming terminal 110*a*. Similarly, as shown in a screen shot 160*d* of FIG. 10B, the display area 112*b* of the second gaming terminal 110*b* displays the sixty-eight free plays and any awards (e.g., credits) associated therewith to the player of the second gaming terminal 110*b*.

As described above, multipliers achieved (e.g., players of the gaming terminals 110*a* of the first type) and multipliers purchased (e.g., players of the gaming terminals 110*b* of the second type) can be used to increase the number of free plays of the reel bonus game achieved during play of the community game (e.g., an award of five free plays is multiplied by a 2× multiplier for an award of ten free plays). Alternatively, the multipliers are not applied to increase the number of free plays of the reel bonus game, but rather are used to increase any awards achieved during the free plays of the reel bonus game. For example, suppose a player of the gaming terminal 110*a* of the first type is permitted to participate in the community game because the player was actively playing the underlying wagering game when the community game was triggered. At the time the community game was triggered, the player had achieved a multiplier of 3× (e.g., the player collected a sufficient number of special symbols to achieve a 3× multiplier). During play of the community game, winning positions 242 associated with two, five, and twelve free plays of the reel bonus game are randomly selected. Thus, the player won a total of nineteen free plays of the reel bonus game. After the community game, the nineteen free plays of the reel bonus game are conducted, which results in an award of, for example, three hundred credits. The award of three hundred credits is then multiplied by the player's achieved 3× multiplier for a total bonus award of nine hundred credits achieved by the player.

Alternatively to the gaming terminals 110*b* of the second type being thin clients, the gaming terminals 110*b* of the second type can be intermediate clients and/or thin clients. By intermediate client, as described above, it is meant that the housing 111*b* of each of the second type of gaming terminals 110*a* includes any one or two of, but not all three of, an RNG, game logic, and game assets therein (e.g., the game logic and game assets are onboard and the RNG is external, or the game assets are onboard and the RNG and the game logic are external).

As mentioned above, the community game includes positions 242 and sections 232 that are associated with awards. Some of the awards are credits and/or money and others of the awards are free plays of a bonus game that can result in awards of credits and/or money. The resulting awards of credits and/or money are funded by the players of the gaming terminals 110*a*, 110*b*. Specifically, the players make wagers of credits and/or money to play the wagering games. A portion of the wagers made are used to effectively fund (e.g., payout) awards related to the community game. In some implementations, awards achieved during the community game by a player of the gaming terminals 110*a* of the first type are effectively funded by a percentage (e.g., 33%) of the wagers placed on the underlying wagering games played thereon by the player of the gaming terminals 110*a*. Additionally, in some implementations awards achieved during the community game by a player of the gaming terminals 110*b* of the second type are effectively funded by a percentage (e.g., 100%) of the side wagers placed on the community game played thereon by the player of the gaming terminals 110*b*. In such implementations, any wagers placed by the players of the gaming terminals 110*b* of the second type on underlying wagering games (i.e., not the side wagers on the community game) played thereon (e.g., keno-type basic wagering game) do not fund the community game.

Thus, a difference between the gaming terminals 110*a* of the first type and the gaming terminals 110*b* of the second type is how they each effectively fund the community game. However, while the gaming terminals 110*a* and the gaming terminals 110*b* effectively fund the community game in a different manner, the outcome of the community game (e.g., the randomly selected winning positions 242) is the same for all players of the community game including the players of the gaming terminals 110*a* and the players of the gaming terminals 110*b*. While the outcome is the same for all players, the award(s) achieved by the players is not necessarily the same. For example, the awards for each player are based on the player's respective multiplier and, for the players of the gaming terminals 110*b* of the second type, on the side wagers made by the player. Thus, the community game of the present disclosure has a shared communal experience (e.g., same outcome for all players) with different effective funding and award mechanisms for different types of gaming terminals (e.g., different for traditional thick client, floorstanding terminals primarily dedicated to gaming and thin client, handheld terminals that are not primarily dedicated to gaming).

According to some implementations of the present disclosure, an overall payback percentage of the wagering game (e.g., including an underlying wagering game and the community game) can be different for players of the gaming terminals 110*a* of the first type than for players of the gaming terminals 110*b* of the second type. For example, players of the wagering game via the gaming terminals 110*a* of the first type can enjoy a first overall payback percentage (e.g., 85%, 90%, etc.) and players of the gaming terminals 110*b* of the second type can enjoy a second overall payback percentage (e.g., 95%, 97%, etc.) that is different than the first payback percentage. Alternatively, the overall payback percentage for players of a wagering game (e.g., including an underlying wagering game and the community game) is the same regardless of the type of gaming terminal used by the players.

In some implementations of the present disclosure, players of the community game on the gaming terminals 110*b* of the second type are limited to placing side wagers on a predetermined number of positions 242 of the board 240. For example, the players can be limited to placing side wagers on five or fewer positions 242. Thus, the players of the community game via the gaming terminals 110*b* of the second type have an inferior chance of winning (or the perception of an inferior chance) the community game as compared to the players of the community game via the gaming terminals 110*a* of the first type.

The gaming terminals 110*b* of the second type can be provided by a variety of different manufacturers. In some implementations, the available wagering games (e.g., underlying wagering games) for a player of one of the gaming terminals 110*b* of the second type is based on the manufacturer of the gaming terminal. For example, a first basic wagering game might only be available for play on gaming terminals manufactured by a first manufacturer.

The gaming server can also be configured to download to the various gaming terminals 110*b* different forms of the game logic or game assets needed to conduct a wagering game on the gaming terminals 110*b*. For example, the game logic can be in precompiled, object-code form, and are downloaded in the same form from the gaming server to one or more of the gaming terminals 110*b* of the second type. Because the game logic is already in object-code form, it can be executed directly by the platform (e.g., operating system) being hosted by the client gaming terminal 110*b*. Alternately, the game logic can be embodied as interpretive code that is interpreted and executed in real time by another client gaming terminal 110*b*. The game assets can be streamed from the gaming server to any of the gaming terminals 110*b* on demand, i.e., only as needed by the game logic for presentation of the outcome. Thus, in some aspects, different types of clients 110*a*, 110*b* require different eligibility criteria to be satisfied for participation in the same community game, evaluate the same outcome of the community game to determine which awards are to be awarded to players using the different clients, and award different awards to the players as a function of the type of client they are using. Further, optionally, the gaming server can, for each of the gaming terminals 110*a*, 110*b*, determine whether to download requested game logic and/or game assets in pre-compiled, object-code form, or as interpreted by an interpreter, such as a JAVA or JSON interpreter, as a function of the client requesting the game logic or game assets from the gaming server.

Moreover, different or additional authentication schemes are required for the players using the gaming terminals 110*b* versus those using the gaming terminals 110*a*. Any player can purchase eligibility to place a side wager on a community game using a gaming terminal 110*b*, such as by taking a picture of a QR code and accessing the web page embedded in the URL encoded in the QR code, and accordingly, additional authentication measures are required to associate the proper player account with the player using the gaming terminal 110*b*. It should be emphasized that the gaming terminals 110*b* can be the player's own personal portable computing device that the player brings into a gaming establishment, such that it is "transformed" from a computing device into a gaming terminal once the player accesses the web page(s) corresponding to the community game. Once transformed, the player is able to participate in the community game using a thin client device that has no affiliation or association with an operator of the gaming establishment, with any manufacturer of the gaming terminals 110*a*, or with any owner or licensor of the wagering game including the community game.

Each of the above concepts and obvious variations thereof is contemplated as falling within the spirit and scope of the claimed invention, which is set forth in the following claims.

What is claimed is:

1. A method of operating a gaming system, the gaming system including one or more controllers, a first gaming terminal associated with a first player, and a second gaming terminal associated with a second player, the first gaming terminal primarily used for playing an underlying casino wagering game, the underlying casino wagering game not being available for play on the second gaming terminal, the first and the second gaming terminals being configured to participate in a community game, the first gaming terminal including a display device and one or more electronic input devices, the method comprising:

detecting, via at least one of the one or more electronic input devices of the first gaming terminal, a physical item associated with a monetary value that establishes a credit balance for the first gaming terminal;

initiating play of the underlying casino wagering game at the first gaming terminal in response to an input indicative of a wager covered by the credit balance;

triggering, by at least one of the one or more controllers of the gaming system, the community game during play of the underlying casino wagering game at the first gaming terminal, the community game being distinct from the underlying casino wagering game;

in response to a first eligibility criterion, associated with the first player, being satisfied prior to the triggering, (i) directing the display device of the first gaming terminal to display at least a portion of the community game and (ii) permitting, by at least one of the one or more controllers of the gaming system, the first player to participate in the community game via the first gaming terminal, the first eligibility criterion being dependent upon the initiating play of the underlying casino wagering game at the first gaming terminal;

in response to a second eligibility criterion, associated with the second player, being satisfied prior to the triggering, (i) directing a display device of the second gaming terminal to display at least a portion of the community game and (ii) permitting, by at least one of the one or more controllers of the gaming system, the second player to participate in the community game via the second gaming terminal, the second eligibility criterion being different than the first eligibility criterion and being independent of the second player initiating play of the underlying casino wagering game at the second gaming terminal; and receiving, via at least one of the one or more electronic input devices of the first gaming terminal, a cashout input that initiates a payout from the credit balance.

2. The method of claim 1, wherein the first eligibility criterion is satisfied prior to the triggering when the gaming system receives a plurality of inputs indicative of wagers covered by the credit balance to play the underlying casino wagering game at the first gaming terminal at a predetermined rate of coin-in in a time period prior to the community game being triggered.

3. The method of claim 1, wherein the second eligibility criterion is satisfied prior to the triggering when the gaming system receives an input other than an input indicative of a wager to play the underlying casino wagering game.

4. The method of claim 3, wherein the input received by the gaming system is indicative of a side wager to play the community game without playing the underlying casino wagering game at the second gaming terminal.

5. The method of claim 1, wherein the first gaming terminal is a floorstanding gaming terminal, and wherein the second gaming terminal is a handheld gaming device that is not primarily used for playing casino wagering games thereon.

6. The method of claim 1, wherein the community game includes a plurality of positions, each of the positions being associated with a community award, the method further comprising:

randomly selecting one of the positions as a winning position; and awarding the community award associated with the winning position to the first player in response to permitting the first player to participate in the community game.

7. The method of claim 6, further comprising awarding the community award associated with the winning position to the second player in response to permitting the second player to participate in the community game.

8. The method of claim 1, further comprising:

capturing a two-dimensional scanable code using a camera of the second gaming terminal; and in response to the capturing, directing the display device of the second gaming terminal to display a menu of wagering games, the menu including the community game.

9. The method of claim 1, wherein the first gaming terminal has game logic for determining an outcome of the underlying casino wagering game being played on the first gaming terminal and wherein the second gaming terminal lacks game logic for determining an outcome of the underlying casino wagering game.

10. The method of claim 1, wherein the first gaming terminal is a thick client including one or more random element generators, game logic, and game assets and the second gaming terminal is a thin client lacking a random element generator, game logic, and game assets.

11. The method of claim 1, wherein the underlying casino wagering game is only available for play on the first gaming terminal.

12. A gaming system comprising:

a first gaming terminal, associated with a first player, primarily used for playing an underlying casino wagering game and being configured to participate in a community game, the first gaming terminal including a display device and one or more electronic input devices;

a second gaming terminal associated with a second player and configured to participate in the community game, the underlying casino wagering game not being available for play on the second gaming terminal; and one or more controllers configured to:

detect, via at least one of the one or more electronic input devices of the first gaming terminal, a physical item associated with a monetary value that establishes a credit balance for the first gaming terminal;

initiate play of the underlying casino wagering game at the first gaming terminal in response to an input indicative of a wager covered by the credit balance;

trigger the community game during play of the underlying casino wagering game at the first gaming terminal, the community game being distinct from the underlying casino wagering game;

in response to a first eligibility criterion, associated with the first player, being satisfied prior to the triggering, (i) direct the display device of the first gaming terminal to display at least a portion of the community game and (ii) permit the first player to participate in the community game via the first gaming terminal, the first eligibility criterion being dependent upon the first player playing the underlying casino wagering game at the first gaming terminal; and in response to a second eligibility criterion, associated with the second player of the second gaming terminal, being satisfied prior to the triggering, (i) direct a display device of the second gaming terminal to display at least a portion of the community game and (ii) permit the second player to participate in the community game, the second eligibility criterion being different than the first eligibility criterion and being independent of the second player playing the underlying casino wagering game at the second gaming terminal; and receive, via at least one of the one or more electronic input devices of the first gaming terminal, a cashout input that initiates a payout from the credit balance.

13. The gaming system of claim 12, wherein the first eligibility criterion is satisfied prior to the triggering when the first player plays the underlying casino wagering game at a predetermined rate of coin-in in a time period prior to the community game being triggered.

14. The gaming system of claim 12, wherein the second eligibility criterion is satisfied prior to the triggering when an electronic input device of the second gaming terminal receives an input other than an input indicative of a wager to play the underlying casino wagering game.

15. The gaming system of claim 14, wherein the input received by the electronic input device of the second gaming terminal is indicative of a side wager to play the community game without playing the underlying casino wagering game at the second gaming terminal.

16. The gaming system of claim 12, wherein the first gaming terminal is a floorstanding gaming terminal, and wherein the second gaming terminal is a handheld gaming device that is not primarily used for playing casino wagering games thereon.

17. The gaming system of claim 12, wherein the first eligibility criterion is satisfied prior to the triggering when one or more special symbols are collected during play of the underlying casino wagering game via the first gaming terminal.

18. The gaming system of claim 12, wherein the first gaming terminal has game logic for determining an outcome of the underlying casino wagering game being played on the first gaming terminal and wherein the second gaming terminal lacks game logic for determining an outcome of the underlying casino wagering game.

19. The gaming system of claim 12, wherein the underlying casino wagering game is only available for play on the first gaming terminal.

* * * * *